US007904011B2

(12) United States Patent
Arizumi et al.

(10) Patent No.: US 7,904,011 B2
(45) Date of Patent: Mar. 8, 2011

(54) TEMPERATURE CONTROL UNIT AND IMAGE FORMING APPARATUS INCLUDING SAME

(75) Inventors: Yuko Arizumi, Yokohama (JP); Takeshi Saitoh, Hachioji (JP); Takuma Nakamura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 12/232,001

(22) Filed: Sep. 9, 2008

(65) Prior Publication Data

US 2009/0067868 A1 Mar. 12, 2009

(30) Foreign Application Priority Data

Sep. 11, 2007 (JP) ..... 2007-235153

(51) Int. Cl.
*G03G 15/20* (2006.01)
*G03G 13/20* (2006.01)

(52) U.S. Cl. ..... 399/340; 399/67; 430/124.21

(58) Field of Classification Search ..... 399/67, 399/320, 340; 347/156; 430/124.21, 124.22
See application file for complete search history.

(56) References Cited

U.S. PATENT DOCUMENTS 5,697,020 A 12/1997 Sato et al.
6,141,521 A 10/2000 Yuuki et al.
6,849,367 B2 2/2005 Shoshi et al.
6,915,101 B2 * 7/2005 Goldman et al. ..... 399/340
6,996,354 B2 2/2006 Kimura et al.
7,027,751 B2 4/2006 Miura et al.
7,123,857 B2 10/2006 Harada et al.
7,127,195 B2 10/2006 Kimura et al.
7,175,958 B2 2/2007 Shoshi et al.
7,203,446 B2 4/2007 Miura et al.
7,298,991 B2 11/2007 Kimura et al.
7,309,552 B2 12/2007 Arizumi et al.
7,348,113 B2 3/2008 Shoshi et al.
7,546,080 B2 * 6/2009 Tanaka et al. ..... 399/340
2003/0161656 A1 8/2003 Miura et al.
2003/0190540 A1 10/2003 Shoshi et al.
2004/0013442 A1 1/2004 Suzuki et al.

(Continued)

FOREIGN PATENT DOCUMENTS

JP 59-119364 7/1984

(Continued)

OTHER PUBLICATIONS

English language Abstract JP 2004-109751 dated Apr. 8, 2004.

(Continued)

*Primary Examiner* — Sandra L Brase
(74) *Attorney, Agent, or Firm* — Harness, Dickey & Pierce, P.L.C.

(57) ABSTRACT

A temperature control unit that maintains a temperature of a fixing liquid includes a container, some or all of which is formed of a heat conservation member, configured to store the fixing liquid that dissolves or causes a toner to swell, a heater provided to an image forming apparatus for heating the container through the heat conservation member, a temperature sensor for detecting a temperature of the fixing liquid in the container, a controller for controlling an amount of heat that is transferred from the heater to the heat conservation member of the container based on a detection result provided by the temperature sensor, and a fixing liquid applicator for supplying the fixing liquid in the container to a toner on a recording medium so as to fix the toner onto the recording medium. The image forming apparatus includes the temperature control unit.

17 Claims, 10 Drawing Sheets

U.S. PATENT DOCUMENTS

| | | | | |
|---|---|---|---|---|
| 2004/0101328 | A1 | 5/2004 | Kimura et al. | |
| 2004/0126134 | A1 | 7/2004 | Harada et al. | |
| 2005/0106483 | A1 | 5/2005 | Shoshi et al. | |
| 2005/0112487 | A1 | 5/2005 | Shoshi et al. | |
| 2005/0147432 | A1 | 7/2005 | Miura et al. | |
| 2005/0266331 | A1 | 12/2005 | Arizumi et al. | |
| 2005/0281584 | A1 | 12/2005 | Kimura et al. | |
| 2006/0079662 | A1 * | 4/2006 | Fukui et al. | 528/272 |
| 2006/0133866 | A1 * | 6/2006 | Asakura et al. | 399/320 |
| 2006/0263712 | A1 | 11/2006 | Katano et al. | |
| 2007/0036584 | A1 | 2/2007 | Kimura et al. | |
| 2007/0147913 | A1 | 6/2007 | Katano et al. | |
| 2007/0243483 | A1 | 10/2007 | Katano et al. | |
| 2008/0063446 | A1 | 3/2008 | Katano et al. | |
| 2008/0069612 | A1 | 3/2008 | Nakamura et al. | |
| 2008/0213002 | A1 | 9/2008 | Katano et al. | |

FOREIGN PATENT DOCUMENTS

| | | |
|---|---|---|
| JP | 04-218063 | 8/1992 |
| JP | 08-262796 | 10/1996 |
| JP | 3290513 | 3/2002 |
| JP | 2004-109747 | 4/2004 |
| JP | 2006-119277 | 5/2006 |
| JP | 2006-133306 | 5/2006 |
| JP | 2006-163083 | 6/2006 |
| JP | 2006-195429 | 7/2006 |
| JP | 4009513 | 9/2007 |

OTHER PUBLICATIONS

English language Abstract JP 07-044034 dated Feb. 14, 1995.

* cited by examiner

TEMPERATURE CONTROL UNIT AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2007-235153 filed on Sep. 11, 2007 in the Japan Patent Office, the entire contents of which are hereby incorporated herein by reference.

BACKGROUND OF THE INVENTION

1. Field of the Invention

Exemplary aspects of the present invention generally relate to a temperature control unit and an image forming apparatus including the temperature control unit.

2. Description of the Background Art

Generally, image forming apparatuses, such as a printer, a facsimile, and a copying machine, form an image including characters and/or graphics on a recording medium such as paper, cloth, an OHP sheet, and so forth based on image information.

There are different types of image forming apparatuses using different recording methods. In particular, an image forming apparatus using an electrophotographic method is widely used in offices, because fine images can be formed on normal paper at a relatively high speed.

Such an electrophotographic image forming apparatus is generally equipped with a charging device, a writing device, a developing device, a transfer device, a cleaning device, a charge-neutralization device, and so forth, which are disposed around a drum-type or a belt-type photoconductive image bearing member.

The image bearing member is charged while rotating. Then, an electrostatic latent image is formed on the surface of the image bearing member based on image information. The electrostatic latent image is developed with toner so that a visible toner image is formed on the surface of the image baring member.

Subsequently, the toner image is transferred onto a recording medium directly or indirectly, depending on the type of intermediate transfer medium employed. In a case in which the toner image is transferred through a belt-type intermediate transfer medium, the toner image is transferred indirectly.

After the toner image is transferred onto the recording medium, the recording medium is guided to the fixing device, where the toner on the recording medium is fixed. The surface of the image bearing member is cleaned by the cleaning device after the image is transferred, and the charge on the surface of the image bearing member is removed by the charge-neutralization device in preparation for a subsequent imaging cycle.

In such an electrophotographic image forming apparatus, a thermal fixing method is widely employed. In the thermal fixing method, a heating device such as a halogen heater or a ceramic heater heats and fuses the toner on a recording medium. The fused toner is then pressed against the recording medium so that the toner is fixed onto the recording medium. The thermal fixing method is preferred because a relatively fast fixing speed can be achieved, and the quality of the fixed image is relatively good.

However, the image forming apparatus using a fixing device using such a thermal fixing method tends to consume a significant amount of electric power in order to heat the toner. Further, a rise time of the fixing device using the thermal fixing method for starting the fixing process tends to be long in such an image forming apparatus.

By contrast, due to increased awareness of environmental problems in recent years, a fixing device capable of low electric power consumption is desired.

In view of the above, Japanese Patent Unexamined Application Publication No. Sho59-119364 and Japanese Patent No. 3290513 suggest, for example, a non-heating fixing method, in which a toner is dissolved or caused to swell by the fixing liquid and then dried so that the toner is fixed. Such a non-heating fixing method allows the toner to be fused without heat, compared to the thermal-fixing method using heat to fuse the toner. Thus, the non-heating fixing method is an ideal fixing method in terms of low electric power consumption and energy saving. It is desirable that the fixing liquid be stably supplied regardless of an operating environment.

However, a drawback of the non-heating fixing method is that the viscosity of the fixing liquid fluctuates depending on the temperature of the operating environment. Thus, when using a fixing liquid, the viscosity of which decreases as the temperature of the fixing liquid rises, the viscosity of the fixing liquid of this kind drops when the temperature of the operating environment is relatively high. Consequently, an amount of the fixing liquid supplied is most likely to increase, thus unnecessarily consuming a large amount of the fixing liquid and causing curling and/or cockling of the recording medium.

By contrast, the viscosity of the fixing liquid increases when the temperature of the operating environment is relatively low. Consequently, an amount of the fixing liquid supplied is most likely to decrease, thereby causing possible fixing failure.

In an attempt to solve such problems, Japanese Patent Unexamined Application Publication Nos. 2004-109751 and 2006-195429 suggest a method for controlling the temperature of the fixing liquid.

For example, a heater is provided in a tank containing the fixing liquid so that the temperature of the fixing liquid can be regulated. Further, it is also suggested that a heater be provided in an eject head, through which the fixing liquid is ejected, so as to regulate the temperature of the fixing liquid before the fixing liquid is ejected.

However, only that portion of the fixing liquid that is near the heater is directly heated in the above described methods. Thus, when the temperature of the operating environment is relatively low such as in a cold region or in the morning, the temperature of that portion of the fixing liquid that is relatively far from the heater is lower than that of the fixing liquid near the heater, causing the temperature of the fixing liquid to vary. As a result, the viscosity of the fixing liquid also varies, causing the supply amount of the fixing liquid to fluctuate.

In an attempt to solve the problem described above, one possible solution may be to provide an agitation device to agitate the fixing liquid while heating the fixing liquid. However, such a configuration tends to be complicated, thereby complicating maintenance as well. Further, there is a problem with this configuration including the mixing device in that the size of the device is difficult to reduce, thereby complicating efforts to make the image forming apparatus as a whole as compact as is usually desired.

In view of the above, in order to heat the fixing liquid evenly, it is possible to use a relatively large heater so as to increase the electric power of the heater, thereby making it possible to heat the entire fixing liquid. However, As described above, such an approach is undesirable in view of reducing power consumption and energy saving, since increasing the size of the heater simply increases the amount of electric power consumed, thereby defeating the purpose of using a fixing liquid in the first place.

In another aspect, in recent years, as electrophotographic image forming apparatuses have become widely used, a large amount of printed waste paper material and toner waste is discarded, leading to environmental concerns over the safety of such waste and contamination of the environment.

Conventionally, widely-used resins used in conventional toner include, for example, polystyrene, styrene-acrylic, polyester, epoxy, styrene-butadiene, and so forth. Generally, the toner including the resins described above is incinerated or buried in landfill when discarded.

Incinerating the toner including such resins requires a large amount of energy, thus easily damaging a furnace and shortening the life of the furnace. Moreover, toxic gases such as carbon monoxide, sulfur compounds, chlorine and so forth are generated in the process of incineration, contaminating the atmosphere.

In addition, because the resins described above have relatively high chemical stability, when buried in landfill the resins remain semi-permanently in their original form without being degraded. Therefore, such resins may adversely affect the environment and consequently pose a hazard to human health.

Furthermore, when such resins are discarded in the environment, the resins remain largely unaltered in the ground for an extended period of time, so that it is highly possible for wildlife to consume the resins inadvertently, which may disrupt local ecosystems.

Moreover, in order to recycle resources, one key task is to recycle or reuse normal paper. However, de-inking of conventional styrene resin is difficult to perform by conventional alkaline hydrolysis.

In light of the above, a toner including a biodegradable resin for toner that is harmless to human health and by definition biodegradable over time is proposed in Japanese Patent Unexamined Application Publication Nos. Hei04-218063 and Hei08-262796. However, such a toner is most likely to be used in the thermal fixing method rather than in the non-heating fixing method. Thus, it is desirable to be able to use a toner including a biodegradable resin in the image forming apparatus using the non-heating method.

However, although toner including biodegradable resin is fused or caused to swell in the fixing liquid more easily than the conventional toner, the fluidity of the toner is difficult to decrease. Further, toner including the biodegradable resin tends to have a viscosity that easily causes offset. For this reason, when using toner including biodegradable resin in an image forming apparatus using the non-heating method, consistent supply of the fixing liquid is particularly important.

SUMMARY OF THE INVENTION

Exemplary embodiments of the present invention provide a temperature control unit to maintain a temperature of a fixing liquid. The temperature control unit includes a container, a heater, a temperature sensor, a controller, and a fixing liquid applicator. The container, all or some of which is formed of a heat conservation member, is configured to store the fixing liquid that dissolves or causes a toner to swell. The heater provided to an image forming apparatus is configured to heat the container through the heat conservation member. The temperature sensor is configured to detect a temperature of the fixing liquid in the container. The controller is configured to regulate an amount of heat that is transferred from the heater to the heat conservation member of the container based on a detection result provided by the temperature sensor. The fixing liquid applicator is configured to supply the fixing liquid in the container to a toner on a recording medium to fix the toner thereto.

According to another preferred embodiment of the present invention, an image forming apparatus includes at least an image bearing member, a latent image forming device, a developing device, a transfer device, and a temperature control unit. The image bearing member is configured to bear a latent image on a surface thereof. The latent image forming device is configured to form the latent image on the image bearing member. The developing device is configured to develop the latent image with a developer including a toner to form a toner image. The transfer device is configured to transfer the toner image on the image bearing member onto a recording medium. The temperature control unit is configured to maintain a temperature of a fixing liquid and includes a container, a heater, a temperature sensor, a controller, and a fixing liquid applicator. The container, some or all of which is formed of a heat conservation member, is configured to store the fixing liquid that dissolves or causes the toner to swell. The heater provided to an image forming apparatus is configured to heat the container through the heat conservation member thereof. The temperature sensor is configured to detect a temperature of the fixing liquid in the container. The controller is configured to control an amount of heat that is transferred from the heater to the heat conservation member of the container based on a detection result provided by the temperature sensor. The fixing liquid applicator is configured to supply the fixing liquid in the container to the toner on a recording medium to fix the toner onto the recording medium.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
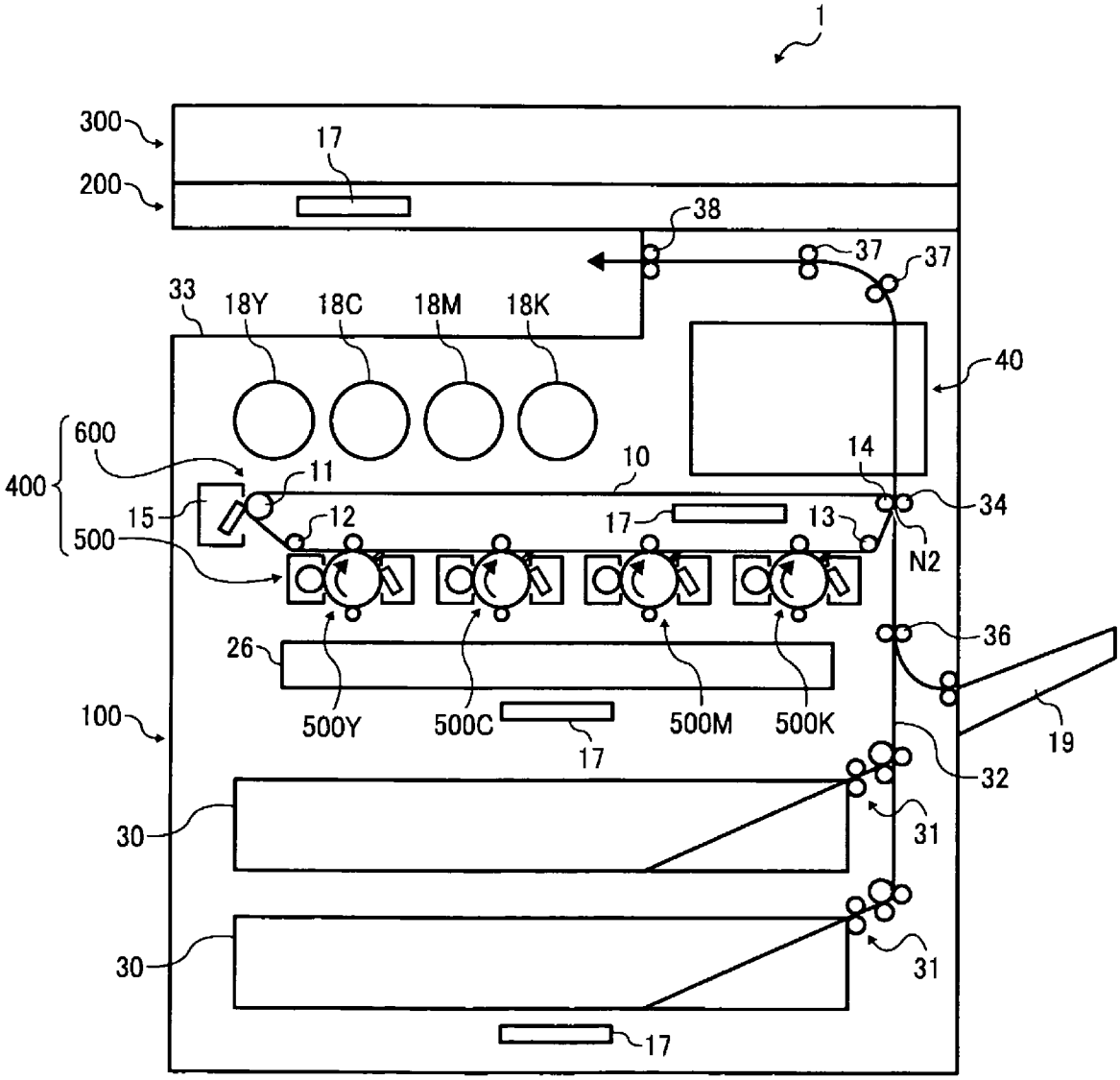
FIG. 1 is a schematic diagram illustrating an example of an image forming apparatus, according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Exemplary embodiments of the present invention are now described below with reference to the accompanying drawings.

In a later-described comparative example, exemplary embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example-of an image forming apparatus, for example, a tandem-type color electrophotographic copier, according to an exemplary embodiment of the present invention is described.

FIG. 1 is a schematic diagram illustrating a multi-function printer as one example of a tandem-type image forming apparatus using an electrophotographic method (hereinafter simply referred to as image forming apparatus.)

In FIG. 1, the image forming apparatus includes an image forming unit 100, a scanner 200 disposed substantially above the image forming unit 100, and an automatic document feeder (ADF) 300 disposed substantially above the scanner 200. It is to be noted that when the scanner 200 and the ADF 300 are removed from the image forming apparatus, the image forming apparatus can be used simply as a printer.

Figure 2:
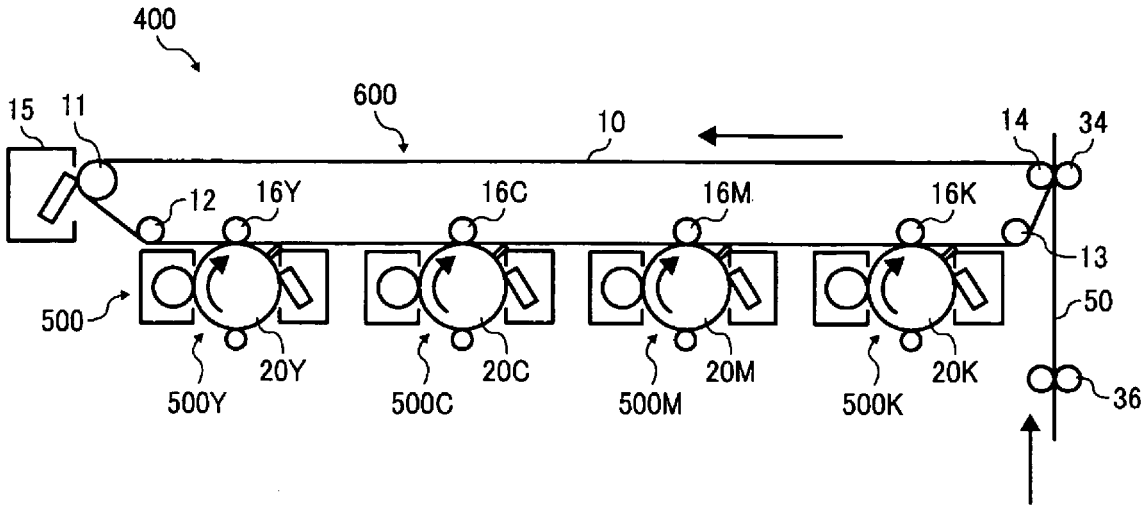
FIG. 2 is an enlarged schematic diagram illustrating an image forming mechanism in the image forming apparatus of FIG. 1, according to an exemplary embodiment of the present invention.

An image forming mechanism 400 is provided in the image forming unit 100. As illustrated in FIG. 2, the image forming mechanism 400 is equipped with image forming devices 500Y, 500C, 500M, and 500K for yellow, cyan, magenta, and black, respectively, and an intermediate transfer device 600. The intermediate transfer device 600 includes an endless intermediate transfer belt 10 which is wound around four rollers 11, 12, 13, and 14. A belt cleaning device 15 is provided at substantially the left of the intermediate transfer belt 10.

It is to be noted that reference characters Y, C, M, and K denote colors yellow, cyan, magenta, and black, respectively.

Figure 3:
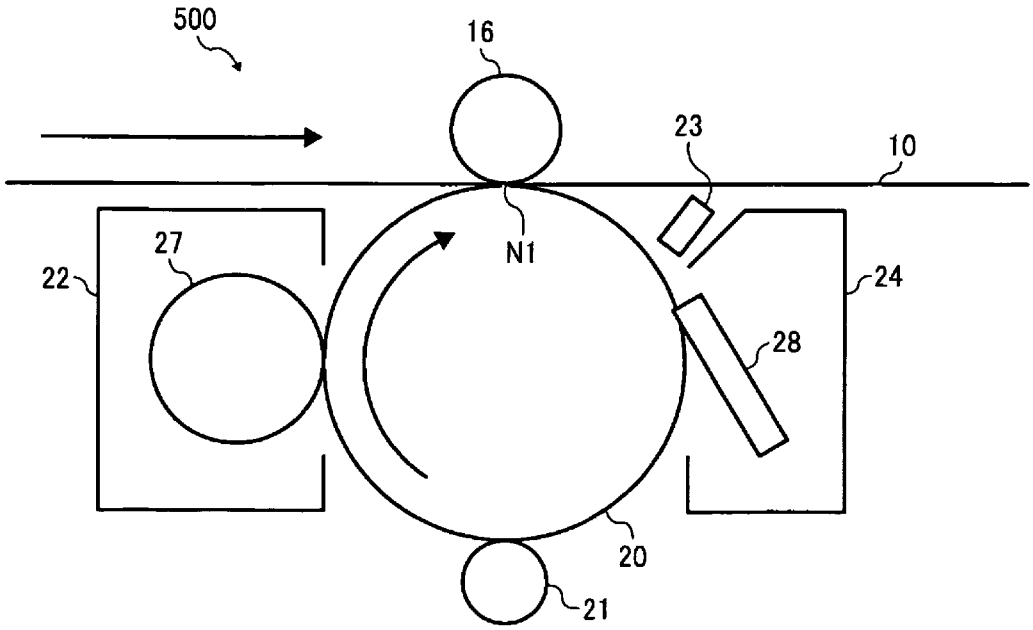
FIG. 3 is a schematic diagram illustrating one of image forming devices in the image forming mechanism of FIG. 2, according to an exemplary embodiment of the present invention.

The four image forming devices 500Y, 500C, 500M, and 500K have the same configuration, except for the color of toner employed. The image forming devices 500Y, 500C, 500M, and 500K are aligned next to each other along the intermediate transfer belt 10 substantially under the intermediate transfer device 600. FIG. 3 illustrates one of the image forming devices 500Y, 500C, 500M, and 500K as a representative example of the image forming devices 500Y through 500K. Therefore, to simplify the description, the reference characters Y, M, C, and K indicating colors are omitted herein.

Each of the image forming devices 500Y, 500C, 500M, and 500K includes a drum-type image bearing member 20. As illustrated in FIG. 3, a charging device 21, a developing device 22, a primary transfer device 16 equipped with a transfer roller across from the intermediate transfer belt 10, a charge-neutralizing device 23 including a charge-neutralizing lamp, a cleaning device 24, and so forth are provided around the image bearing member 20.

The charging device 21 contacts the image bearing member 20 and applies voltage thereto, thereby uniformly charging the surface of the image bearing member 20. According to the exemplary embodiment, the charging device 21 is a contact-type charging device using a charging roller. Alternatively, the charging device 21 may use a charging brush or a scorotron charging method.

The developing device 22 includes a mixing portion and a developing portion. In the mixing portion of the developing device 22, a developer not having been used during development is returned to the mixing portion and reused. A toner density of the developing portion is detected by a toner density sensor and regulated at a certain density.

The primary transfer device 16 uses a transfer roller. As illustrated in FIG. 2, each of the primary transfer devices 16Y, 16C, 16M, and 16K is disposed so as to press the image bearing members 20Y, 20C, 20M, and 20K, respectively, across from the intermediate transfer belt 10. Alternatively, the primary transfer device 16 may use a conductive brush, a non-contact type corona charger, or the like.

As illustrated in FIG. 1, an exposure device 26 is provided substantially below the image forming mechanism 400. The exposure device 26 forms an electrostatic latent image on each of the image bearing members 20 provided to the image forming device 500 in accordance with image information of a document read by the scanner 200, for example.

While the image bearing member 20 rotates in a clockwise direction, the surface of the image bearing member 20 is uniformly charged by the charging device 21. Subsequently, based on an image signal, the exposure device 26 illuminates the image bearing member 20 with light so as to form the electrostatic latent image thereon.

Subsequently, a developing sleeve 27 in the developing device 22 illustrated in FIG. 3 adheres a toner to the image bearing member 20. The toner adhered to the image bearing member 20 is primarily transferred onto the intermediate transfer belt 10 at a primary transfer nip N1 where the primary transfer device 16 is pressed against the image bearing member 20 via the intermediate transfer belt 10.

After a surface potential of the image bearing member 20 is initialized and neutralized by the charge-neutralization device 23, a toner which has not been transferred, thus remaining on the image bearing member 20, is removed by a cleaning member 28 such as a cleaning blade in the drum cleaning device 24 as illustrated in FIG. 3 in preparation for the subsequent image forming operation.

The toner collected by the drum cleaning device 24 is recovered to the developing device 22 by a recovery screw or a toner recycling device (not shown) so as to be able to reuse the toner.

Referring back to FIG. 1, a plurality of sheet feed trays 30 is substantially below the exposure device 26. Each of the sheet feed trays 30 is provided with a sheet feed mechanism 31 configured to feed recording sheets one sheet at a time.

In the image forming unit 100, a sheet conveyance path 32 is provided to transport the recording medium fed by the sheet feed mechanism 31. The sheet conveyance path 32 is provided such that the sheet conveyance path 32 extends upward from each of the sheet feed trays 30 to a sheet stack portion 33 located between the image forming unit 100 and the scanner 200.

In the sheet conveyance path 32, a transfer roller of a secondary transfer device 34 is provided across from the intermediate transfer device 600, thereby forming a secondary transfer position N2.

A pair of registration rollers 36 is provided upstream the secondary transfer position N2. A fixing device 40 is provided downstream the secondary transfer position N2. Further downstream the fixing device 40, two sets of a pair of conveyance rollers 37. Further downstream the conveyance rollers 37, a pair of sheet discharge rollers 38 is provided. Alternatively, the secondary transfer device 34 may include a transfer belt or a transfer charger instead of the transfer roller.

Along with rotation of the intermediate transfer belt in a counterclockwise direction in FIG. 1, toner images of yellow, cyan, magenta, and black formed on the image forming devices 500Y, 500C, 500M, and 500K, respectively, are sequentially overlappingly transferred onto the intermediate transfer belt 10 at the primary transfer nip N1. Accordingly, a color image is formed on the intermediate transfer belt 10.

The recording medium fed by the sheet feed mechanism 31 is directed along the sheet conveyance path 32 to the secondary transfer position N2 by the registration rollers 36 at appropriate timing.

The color image formed on the intermediate transfer belt 10 is secondarily transferred by the secondary transfer device 34 onto the recording medium sent to the secondary transfer position N2.

Subsequently, the recording medium is transported to the fixing device 40. The toner image on the recording medium is fixed by the fixing device 40 and is transported further by the pair of the conveyance rollers 37. The recording medium is discharged onto the sheet stack portion 33 by the pair of the sheet eject rollers 38.

At this time, the toner not having been transferred and remaining on the intermediate transfer belt 10 is removed by a cleaning member, for example, a cleaning blade of a belt cleaning device 15.

The image forming apparatus illustrated in FIG. 1 normally includes heating devices to dehumidify the image forming apparatus. According to the exemplary embodiment, the image forming apparatus includes four heaters 17, each of which serves as a heating device to dehumidify, for example. Three heaters 17 are provided in the image forming unit 100. One heater is provided in the scanner 200.

A known heater can be employed as the heaters 17. For example, heat emission of a sheathed heater, a sheet heater (a sheet-type heating element), or the like can be used to dehumidify the image forming apparatus, when the heater is turned on. In addition, the number of the heaters 17 is not limited to four as in the exemplary embodiment. Instead, four or fewer, or more than four heaters 17 can be employed. It is to be noted also that the arrangement of the heaters 17 is not limited to the arrangement illustrated in FIG. 1.

Toner bottles 18Y, 18C, 18M, and 18K are replaceably provided in the image forming unit 100. The toner bottles 18Y, 18C, 18M, and 18K store a respective color of toner to be supplied to the image forming devices 500Y, 500C, 500M, and 500K. A manual sheet feed tray 19 is provided to the image forming unit 100.

Figure 4:
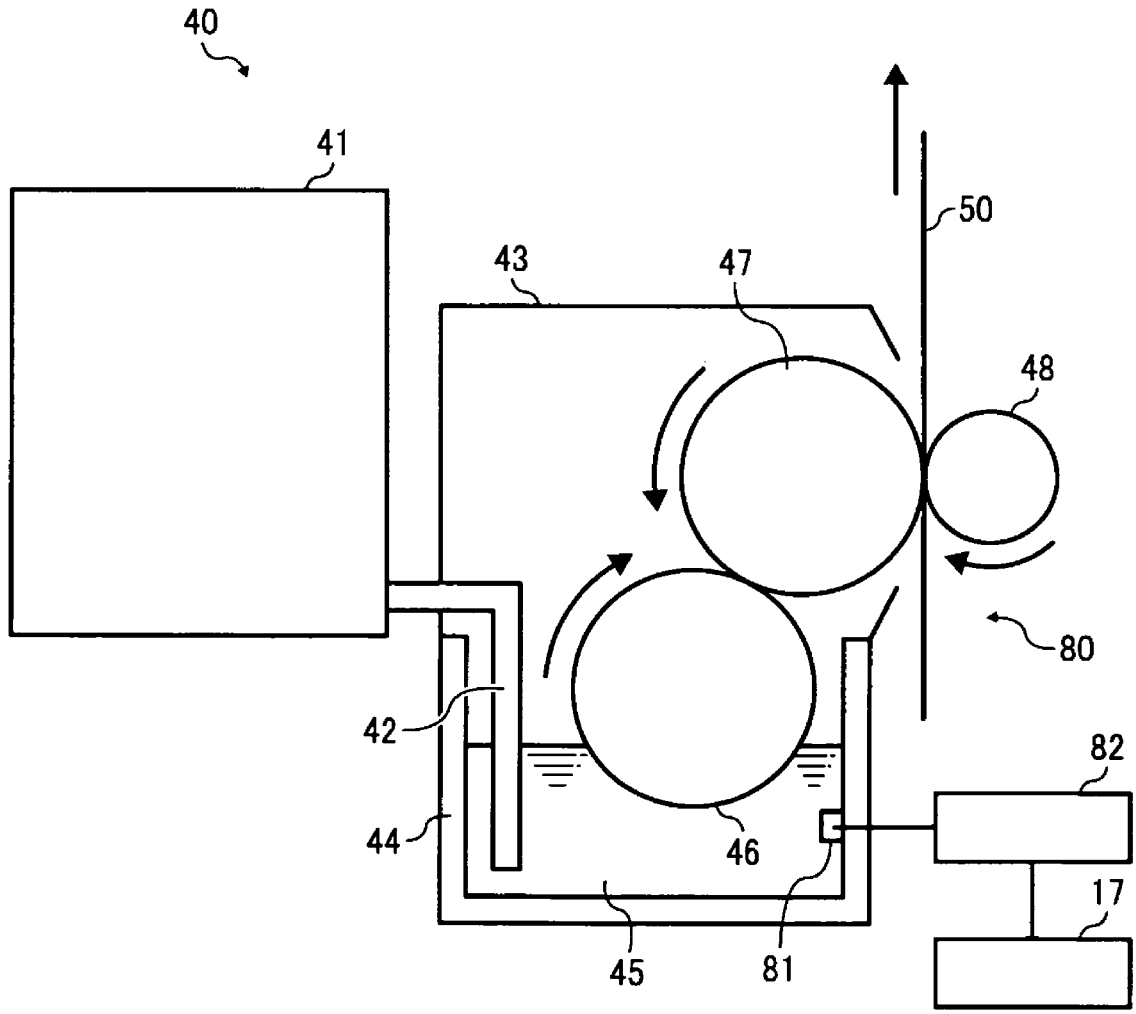
FIG. 4 is a schematic diagram illustrating a fixing device of the image forming apparatus of FIG. 1, according to an exemplary embodiment of the present invention.

Referring now to FIG. 4, there is provided a schematic diagram illustrating the fixing device 40 of the image forming apparatus illustrated in FIG. 1. The fixing device 40 includes at least a fixing liquid tank 41, a supply tube 42, and a fixing liquid chamber 43.

The fixing liquid tank 41 is replaceably provided to the image forming unit 100 and stores the fixing liquid that fuses or causes the toner to swell. The fixing liquid is supplied to the fixing liquid chamber 43 through the supply tube 42.

The fixing liquid chamber 43 is a container, some or all of which is formed of a material that conserves heat. According to the exemplary embodiment illustrated in FIG. 4, a bottom half of the fixing liquid chamber 43 is formed of a heat conservation member 44, and the fixing liquid 45 supplied from the fixing liquid tank 41 is stored therein.

The heat conservation member 44 may be formed of a known material, including, but are not limited to, paraffin, sodium acetate, sodium acetate hydrate, calcium chloride hydrate, sodium sulfate hydrate, sodium thiosulfate hydrate, sodium carbonate, and the like, held in a designated container or covered with a coating material, and ceramics, and metal, or any other suitable material.

Although not illustrated, a water level sensor and a water level controller are provided to the fixing liquid chamber 43. In accordance with the amount of the fixing liquid 45 consumed, the fixing liquid 45 is supplied from the fixing liquid tank 41 to the fixing liquid chamber 43 through the supply tube 42 so that a certain amount of the fixing liquid 45 is consistently stored in the fixing liquid chamber 43.

In order to prevent foreign substances from mixing into the fixing liquid 45, the fixing liquid chamber 43 may be provided with a filter.

The foregoing description pertains to the fixing liquid chamber 43, a portion of which is formed of the heat conservation member 44. Alternatively, not only the fixing liquid chamber 43, but also some or all of the fixing liquid tank 41 or the supply tube 42 may be covered with the heat conservation member 44.

Inside the fixing liquid chamber 43, a wire bar roller 46 and a roller-type applicator 47 are provided. The wire bar roller 46 is provided such that a portion thereof contacts directly the fixing liquid 45 stored in the fixing liquid chamber 43.

The roller-type applicator 47 serving as a fixing liquid application member is provided to contact the wire bar roller 46. Material for the applicator 47 preferably includes solvent resistant material including urethane rubber, fluoro-rubber and silicone rubber, or the like. The surface of the applicator 47 may include a porous surface or a mesh surface so that an area contacting the toner can be reduced, thereby suppressing offset.

A pressure member 48 is pressed against the applicator 47. Material for the pressure member 48 may include preferably solvent resistant material, for example, fluoro-rubber, silicone rubber, and the like, or metal.

When pressed by the pressure roller 48, the fixing liquid 45 is applied consistently and evenly onto the recording medium 50. Alternatively, a pair of pressure rollers, not shown, that guides a recording medium 50 therebetween may be provided.

In such a configuration, the recording medium 50 passes through the pair of the pressure rollers after the fixing liquid 45 is applied. Accordingly, the surface of the recording medium 50 bearing the toner is smoothed and/or the toner is firmly pressed onto the surface of the recording medium 50 so that glossiness of the surface can be enhanced and fixing ability can be improved.

Subsequently, when the wire bar roller 46 rotates, the fixing liquid 45 in the fixing liquid chamber 43 is supplied and adhered to the applicator 47. The fixing liquid 45 adhered to the applicator 47 is applied to the toner on the recording medium 50 such as a paper sheet passing between the applicator 47 and the pressure roller 48. Accordingly, the toner is fixed on the recording medium 50.

The wire bar roller 46 has a coarse surface, calculated to regulate the amount of the fixing liquid 45 adhering thereto. A thin layer of the fixing liquid 45 is formed and borne on the surface of the applicator 47. The fixing liquid 45 is applied when the toner on the recording medium 50 contacts the applicator 47.

As illustrated in FIG. 4, the fixing device 40 includes a temperature control unit 80 configured to maintain a certain temperature of the fixing liquid 45. The temperature control unit 80 includes the fixing liquid chamber 43, the heater 17, the applicator 47 described above, a temperature sensor 81 and a controller 82.

The temperature sensor 81 including a thermocouple or the like is provided to an inner wall of the fixing liquid chamber 43. The controller 82 is connected to the temperature, sensor 81 and provided outside the fixing liquid chamber 43. The heater 17 described above is connected to the controller 82.

The temperature of the fixing liquid 45 is detected by the temperature sensor 81. Based on the detection result provided by the temperature sensor 81, the controller 82 turns the heater 17 ON/OFF to regulate the amount of heat transmitted from the heater 17 to the heat conservation member 44.

Accordingly, the temperature of the fixing liquid 45 is adjusted to be in the range of approximately 20 to 60 degrees Centigrade. It is to be noted that the heater 17 may be one that integrates the controller 82, so as to be self-controlling.

When the temperature of the fixing liquid 45 is less than 20 degrees C., it is possible that the viscosity of the fixing liquid 45 increases, thereby causing the amount of the fixing liquid 45 supplied to decrease, and thus inducing fixing failure.

By contrast, when the temperature of the fixing liquid 45 is greater than approximately 60 degrees C., it is possible that the viscosity of the fixing liquid 45 decreases, thereby supplying more than the necessary amount of fixing liquid 45. Consequently, more of the fixing liquid 45 may be consumed than necessary, and/or curling and/or cockling of the recording medium may occur. Furthermore, it is possible that a property of the fixing liquid may be altered, resulting in degraded fixing ability.

Heat transmitted from the heater 17 maintains the temperature of the fixing liquid 45. The heated fixing liquid 45 is supplied to the applicator 47. Then, the toner is fused or caused to swell so that the toner on the recording member 50 is fixed onto the recording member 50.

The temperature sensor 81 detects the temperature of the fixing liquid 45 to be supplied by the applicator 47. Based on the detection result provided by the temperature sensor 81, the controller 82 regulates the amount of heat transmitted to the fixing liquid 45 to be applied by the applicator 47 so as to consistently maintain the temperature of the fixing liquid 45 at a predetermined temperature.

According to the exemplary embodiment, the heater 17 used for dehumidifying is employed as the heating device so that the number of parts can be reduced, and thus the power consumption of the image forming apparatus can be reduced, accordingly.

The temperature of the fixing liquid 45 is regulated by the heat conserved by the heat conservation member 44 of the fixing liquid chamber 43. Accordingly, regardless of the operating environment, a predetermined temperature of the fixing liquid 45 can be maintained consistently, thereby making it possible to prevent fluctuation of the viscosity of the fixing liquid 45. Further, an appropriate amount of the fixing liquid 45 can be supplied consistently to the recording medium 50, thereby reducing, if not preventing entirely, excess consumption of the fixing liquid 45.

As described above, curling and/or cockling of the recording medium 50 caused by excessive supplies of the fixing liquid 45 can be reduced, if not prevented entirely, while also reducing or preventing fixing failure caused by inadequate fixing liquid 45.

Further, according to the exemplary embodiment, the heater 17 is disposed outside the fixing liquid 45 so that a simple configuration can be possible, thereby making maintenance operation easy and reducing the size of the apparatus, compared to a configuration in which a heater is provided inside the fixing liquid 45.

In addition, the temperature of the fixing liquid 45 stored in the fixing liquid chamber 43 is maintained by conserving the heat transmitted from the heater 17 in the fixing liquid chamber 43, some or all of which is formed of the heat conservation member 44. Accordingly, heat loss of the heat transmitted to the fixing liquid chamber 43 is reduced, if not prevented entirely, thereby making it possible to effectively use the heat of the heater 17.

According to the exemplary embodiment, the fixing liquid 45 is temporarily stored in the fixing liquid chamber 43, and the temperature sensor 81 detects the temperature of the fixing liquid 45 in the fixing liquid chamber 43. Accordingly, the temperature of the fixing liquid 45 can be accurately detected immediately before the fixing liquid 45 is applied by the applicator 47.

Figure 5:
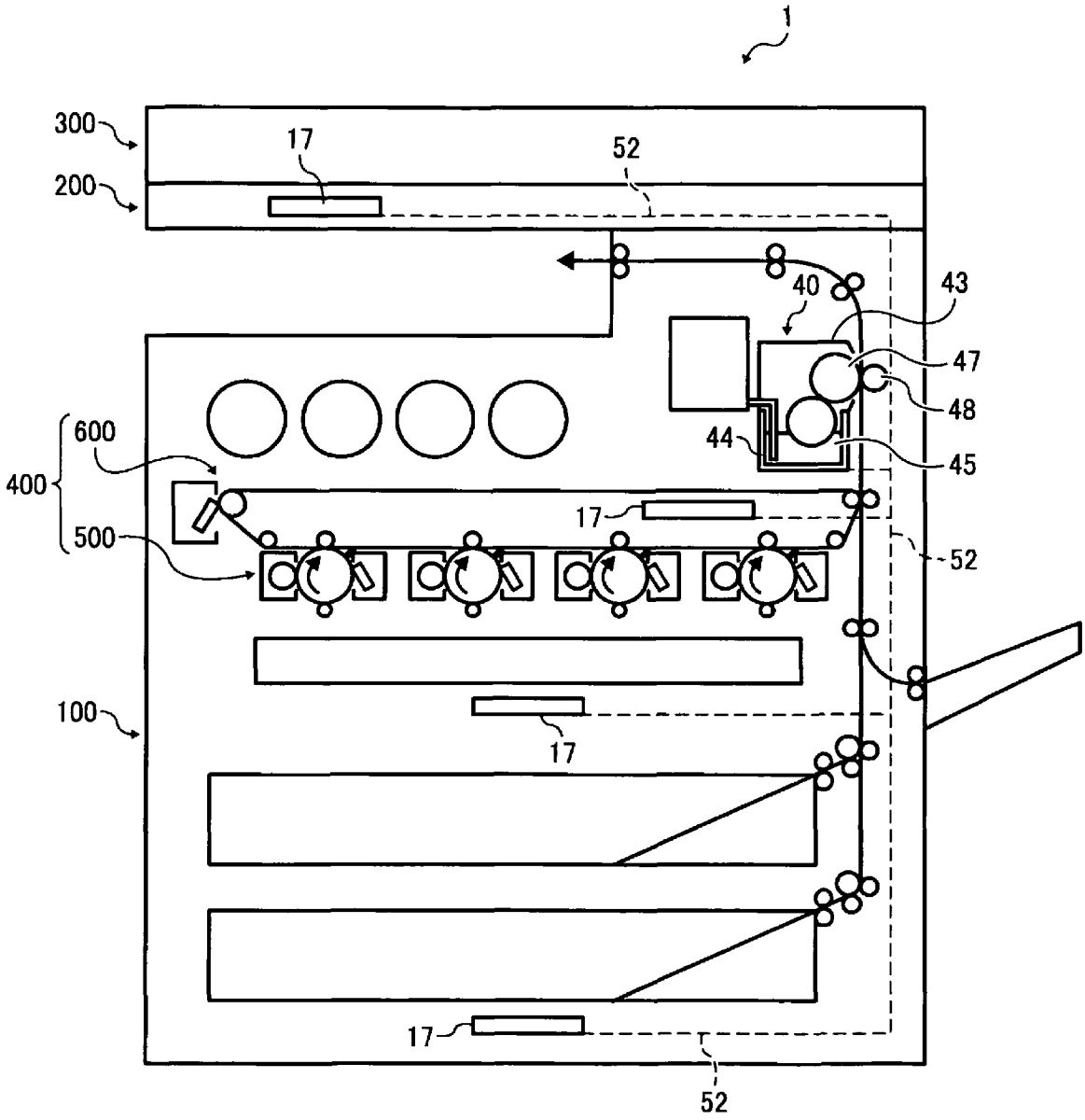
FIG. 5 is a schematic diagram illustrating heat transmission of a heater in the image forming apparatus of FIG. 1, according to an exemplary embodiment of the present invention.

Referring now to FIG. 5, there is provided a conceptual diagram illustrating heat transmission from the heaters 17 to the heat conservation member 44 in the image forming apparatus of FIG. 1.

As illustrated in FIG. 5, the image forming apparatus 1 includes a heat transporter 52 serving as a heat transport mechanism which connects the heaters 17 serving as a heating device as described above to the heat conservation member 44 of the fixing liquid chamber 43.

The heat transporter 52 transfers heat from the heaters 17 to the heat conservation member 44 where the heat is then conserved. Subsequently, the heat transporter 52 transfers the heat to the fixing liquid 45 to be applied by the applicator 47 serving as the fixing liquid application mechanism onto the recording medium 50.

For the heat transporter 52, a known material may be used, including, for example, a heat pipe, a heat plane, metal covered with heat insulating material, and the like. The heat transporter 52 may include a structure in which the fixing liquid chamber 43 and the heaters 17 are connected by a heat insulating pipe, and heat from the heaters 17 is transmitted by a fan, for example.

Alternatively, instead of controlling the operation of the heaters 17 with the controller 82, the heat transporter 52 can be turned ON/OFF by the controller 82 to adjust the temperature of the fixing liquid 45 to fall within the range of approximately 20 to 60 degrees Centigrade.

Figure 6:
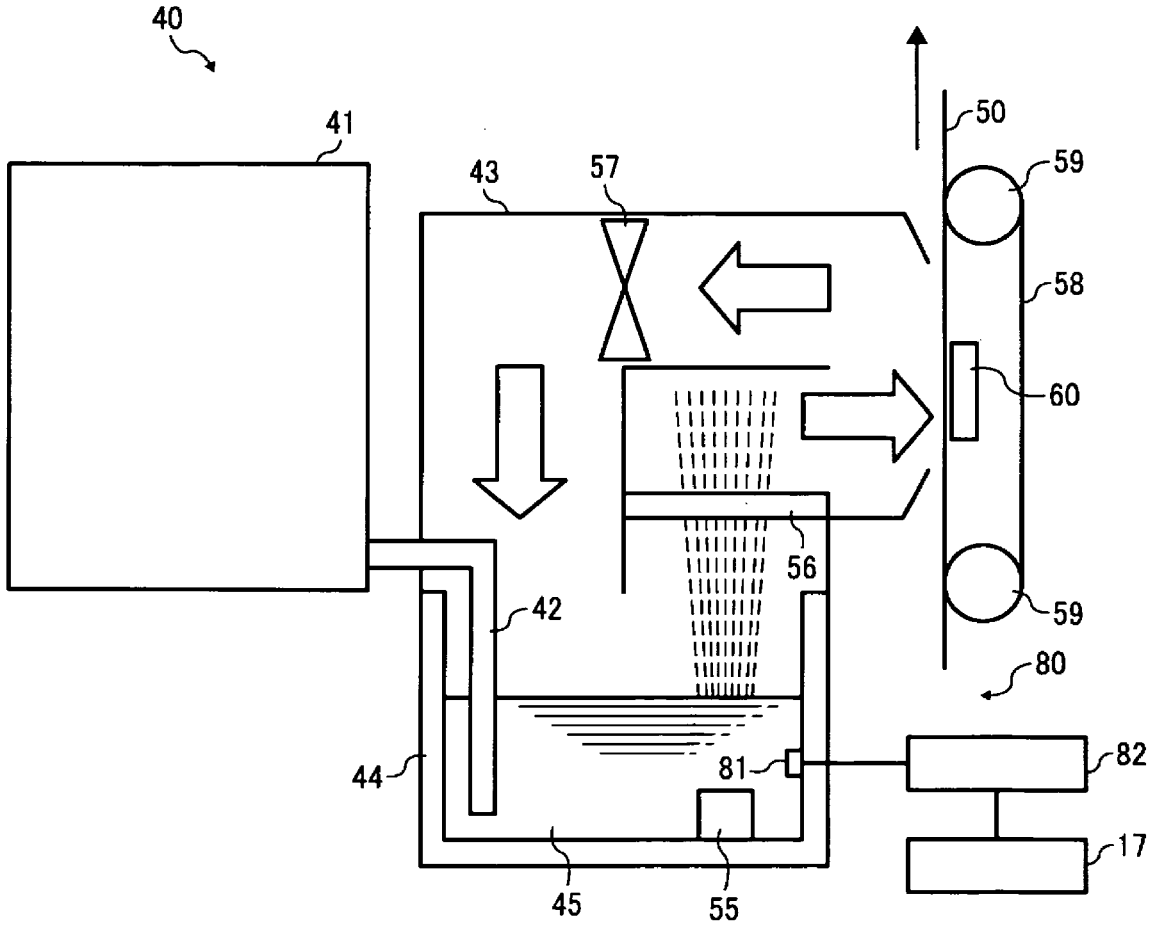
FIG. 6 is a schematic diagram illustrating the fixing device including a temperature control unit, according to another exemplary embodiment of the present invention.

Referring now to FIG. 6, there is provided a schematic diagram illustrating the fixing device 40 including the temperature control unit 80 according to another exemplary embodiment.

According to the present exemplary embodiment, the fixing device 40 includes an ultrasonic transducer 55 serving as a fixing liquid application mechanism, a charging device 56, a fan 57, and so forth, instead of the wire bar roller 46 and the applicator 47 illustrated in FIG. 4. Further, instead of using the pressure roller 48, a conveyance belt 58 is stretched between two rollers 59. It is to be noted that the reference numeral 41 denotes the fixing liquid tank, and 42 denotes the supply tube as illustrated in FIG. 4.

The fixing liquid 45 in the fixing liquid chamber 43 is sprayed as liquid droplets by the ultrasonic transducer 55, and directed onto the recording medium 50 by an aerial current generated by the fan 57. The sprayed liquid droplets are positively charged when the sprayed liquid droplets pass through the charging device 56 in which wires or the like are stretched therein.

After an image is transferred, the recording sheet 50 sent to the fixing device 40 is transported upward by the conveyance belt 58. At this time, the positively charged liquid droplets of the fixing liquid 45 are attracted to the toner due to the Coulomb force. Accordingly, the fixing liquid 45 is applied to the toner selectively or in a concentrated manner contactlessly.

According to the exemplary embodiment, as illustrated in FIG. 6, a second charging device 60 can be provided to an inner loop of the conveyance belt 58. The second charging device 60 applies a negative charge from the rear side of the recording medium 50, so that the positively charged liquid droplets are quickly supplied to the toner on the recording medium.

However, in a case in which the charging polarity of the electrophotographic process is the opposite of the above-described exemplary embodiment, that is, when the toner is positively charged, the sprayed fixing liquid is negatively charged, thereby forming negatively charged liquid droplets. In such a case, the second charging device 60 is configured to apply a positive charge from the rear side of the recording medium 50, so that the negatively charged liquid droplets are quickly supplied to the toner on the recording medium 50.

It is possible to arbitrarily set the charge and the charging amount of the liquid droplets of the fixing liquid 45, and the charge and the charging amount of the toner by the second charging device 60.

The liquid droplets of the fixing liquid 45 which have not been used to fix the toner circulate in the fixing liquid chamber 43 as indicated by hollow arrows in FIG. 6 and then return to the heat conservation member 44.

When a particle diameter of the liquid droplets sprayed is too large, the liquid droplets are likely to aggregate, adversely affecting the toner image on the recording medium 50. For this reason, a particle diameter of the sprayed droplets is preferably less than or equal to approximately 20 μm.

According to the exemplary embodiment, the fixing device 40 includes the temperature control unit 80 configured to maintain a certain temperature of the fixing liquid 45. The temperature control unit 80 includes the fixing liquid chamber 43, the heaters 17 provided in the image forming unit 100, the ultrasonic transducer 55, the temperature sensor 81, and the controller 82. The heaters 17 provided in the image forming unit 100 transmit heat to the heat conservation member 44 of the fixing liquid chamber 43. The ultrasonic transducer 55 fixes the toner on the recording medium 50 by applying the fixing liquid 45 to the toner. The temperature sensor 81 is provided to the inner wall of the fixing liquid chamber 43 so as to detect the temperature of the fixing liquid 45 in the fixing liquid chamber 43. The controller 82 is connected to the temperature sensor 81. Based on the detection result provided by the temperature sensor 81, the controller 82 regulates the amount of heat transmitted from the heaters 17 to the heat conservation member 44.

Figure 7:
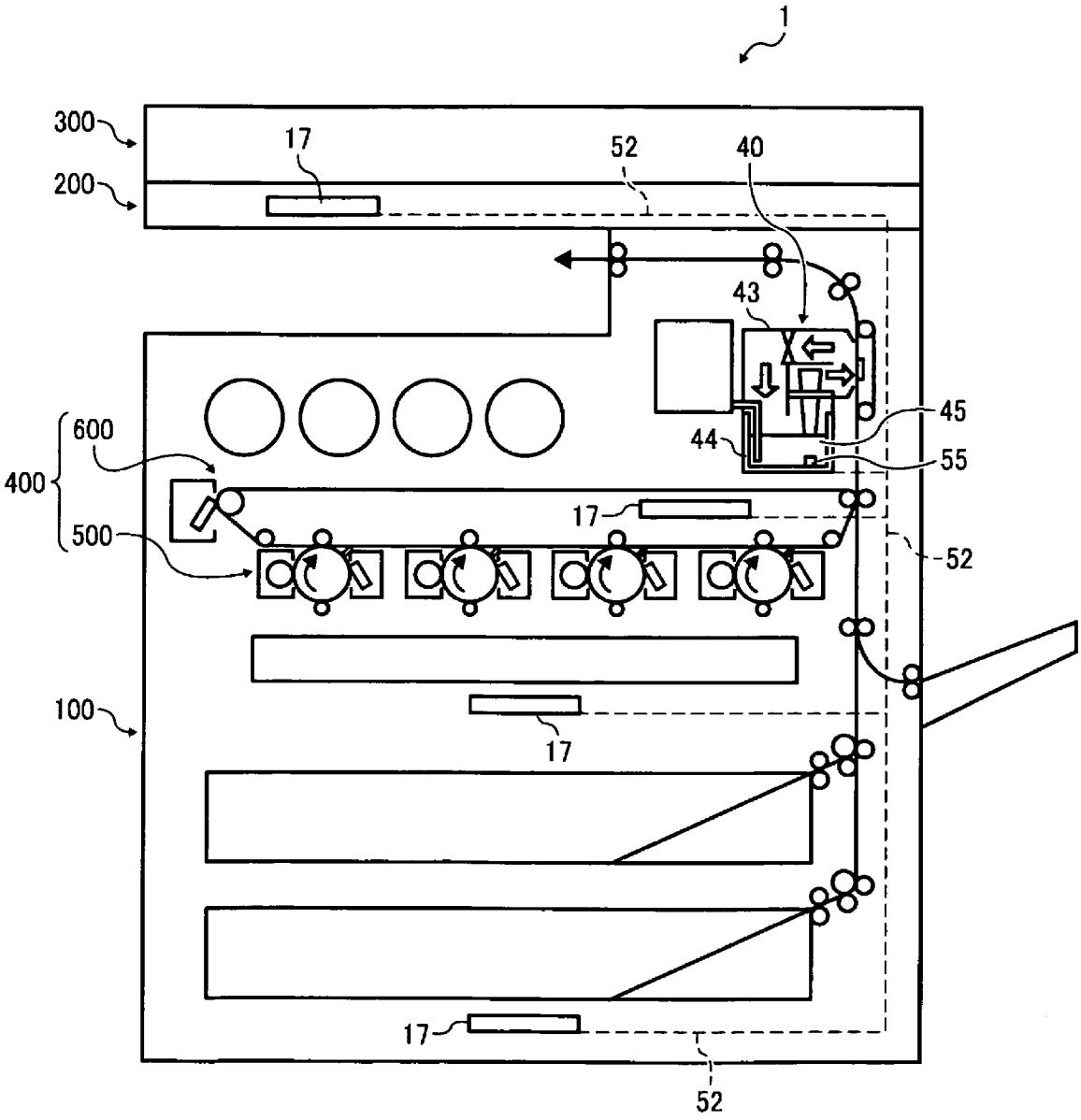
FIG. 7 is a schematic diagram illustrating heat transmission of a heater in the image forming apparatus including the fixing device of FIG. 6, according to another exemplary embodiment of the present invention.

Referring now to FIG. 7, there is provided a conceptual diagram illustrating heat transmission from the heaters 17 to the heat conservation member 44 in the image forming apparatus 1 equipped with the fixing device 40 of FIG. 6.

In FIG. 7, the image forming apparatus 1 includes, similar to the above described image forming apparatus, the heat transporter 52 that connects the heaters 17 serving as the heating mechanism to the heat conservation member 44 of the fixing liquid chamber 43. The heat transporter 52 transfers heat from the heaters 17 to the heat conservation member 44, thereby heating the fixing liquid 45.

In accordance with the detection result provided by the temperature sensor 81 illustrated in FIG. 6, the controller 82 controls of the operation of the heaters 17 to regulate the amount of heat transmitted from the heaters 17 to the heat conservation member 44. Accordingly, the temperature of the fixing liquid 45 is regulated to be in the range of approximately 20 to 60 degrees Centigrade.

Similarly, instead of controlling the operation of the heaters 17 with the controller 82, the controller 82 may control the heat transporter 52, for example, to regulate the temperature of the fixing liquid 45 to be in the range of 20 to 60 degrees C.

Through transmission of heat, the temperature of the fixing liquid 45 is maintained. The ultrasonic transducer 55 serving as the fixing liquid application mechanism sprays the fixing liquid 45 relative to the recording medium 50 so that the toner on the recording medium 50 is fused or caused to swell, thereby fixing the toner onto the recording medium 50.

The temperature sensor 81 detects the temperature of the fixing liquid 45 to be applied by the ultrasonic transducer 55. In accordance with the detection result provided by the temperature sensor 81, the controller 82 regulates the amount of heat transmitted from the heaters 17 to the heat conservation member 44. Accordingly, a predetermined temperature of the fixing liquid 45 can be maintained.

According to the exemplary embodiment, the heaters 17 used for dehumidifying the image forming apparatus are used as the heating device so that no other dedicated heating mechanism is necessary, thereby reducing the power consumption of the image forming apparatus.

The temperature of the fixing liquid 45 is regulated by the heat conserved by the heat conservation member 44 of the fixing liquid chamber 43. Accordingly, regardless of the operating environment, the fixing liquid 45 can be maintained consistently at a predetermined temperature, thereby making it possible to prevent fluctuation of the viscosity of the fixing liquid 45. That is, an appropriate amount of the fixing liquid 45 can be supplied consistently to the recording medium 50 so as to reduce, if not prevent entirely, excess consumption of the fixing liquid 45.

As described above, curling and/or cockling of the recording medium 50 caused by excessive application of the fixing liquid 45 to the recording medium 50 can be reduced, if not prevented entirely, while reducing or preventing fixing failure caused by an inadequate supply of fixing liquid 45.

Further, according to above-described configuration, the heaters 17 are disposed outside the fixing liquid 45 to keep the configuration simple, thereby facilitating maintenance and making it possible to reduce the overall size of the image forming apparatus when compared to a configuration in which the heater is provided in the fixing liquid 45.

In addition, the temperature of the fixing liquid 45 stored in the fixing liquid chamber 43 is maintained by conserving the heat transmitted from the heaters 17 in the fixing liquid chamber 43, some or all of which is formed of the heat conservation member 44. Accordingly, heat loss of the heat transmitted to the fixing liquid chamber 43 is reduced, if not prevented entirely, thereby making it possible to effectively use the heat of the heaters 17.

Further, according to the exemplary embodiment, the fixing liquid 45 is temporarily stored in the fixing liquid chamber 43, and the temperature sensor 81 detects the temperature of the fixing liquid 45 in the fixing liquid chamber 43. Accordingly, the temperature of the fixing liquid 45 can be accurately detected immediately before the fixing liquid 45 is applied by the applicator 47.

Figure 8:
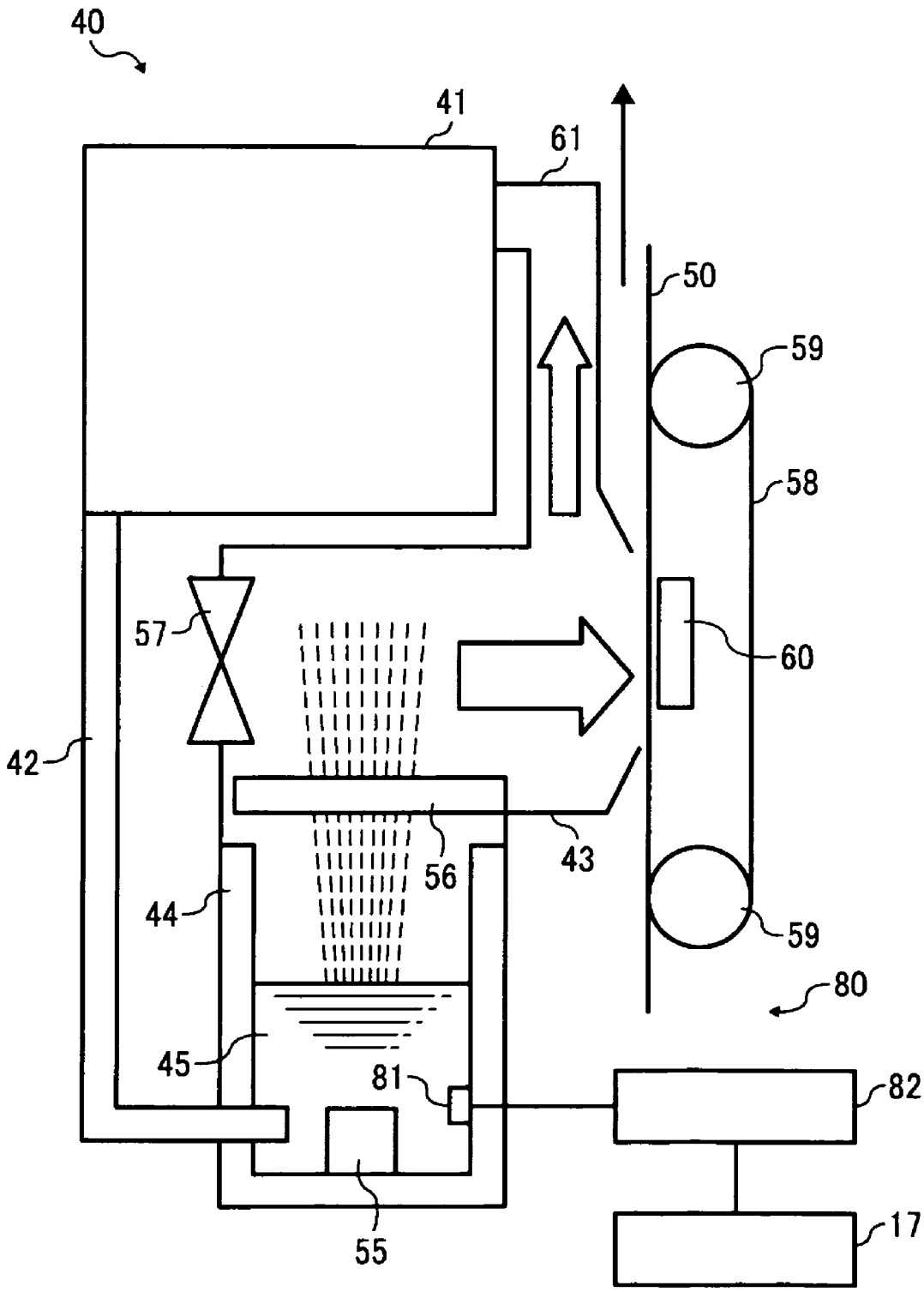
FIG. 8 is a schematic diagram illustrating the fixing device including a temperature control unit, according to still another exemplary embodiment of the present invention.

Referring now to FIG. 8, there is provided a schematic diagram illustrating the fixing device 40 including the temperature control unit 80, according to still another exemplary embodiment of the present invention.

According to the exemplary embodiment, similar to the exemplary embodiment illustrated in FIG. 6, the fixing liquid 45 is supplied to the toner contactlessly. However, the liquid droplets of the fixing liquid 4 which have not been used during fixing of the toner are recovered to the fixing liquid tank 41 through a recovery tube 61.

Accordingly, those liquid droplets of the fixing liquid 45 not having been used during fixing of the toner are recovered consistently, thereby reducing wasteful consumption of the fixing liquid 45.

It is to be noted that the same reference numerals used in FIG. 6 are provided for constituent elements that are the same as or similar to those illustrated in FIG. 8.

Figure 9:
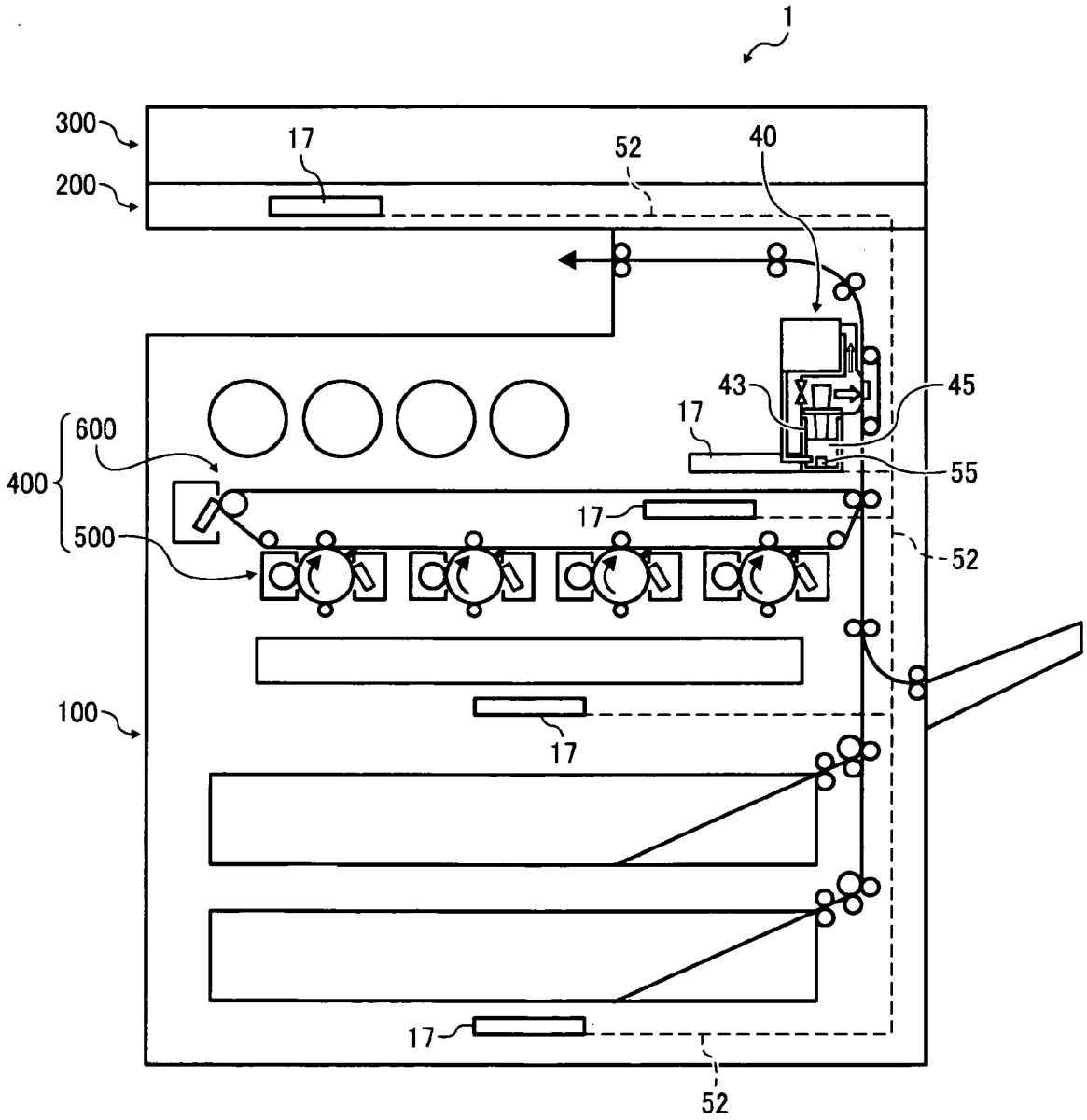
FIG. 9 is a schematic diagram illustrating heat transmission of a heater in the image forming apparatus including the fixing device of FIG. 8, according to still another exemplary embodiment of the present invention.

Referring now to FIG. 9, there is provided a conceptual diagram illustrating heat transmission from the heaters 17 to the heat conservation member 44 in the image forming apparatus 1 equipped with the fixing device 40 of FIG. 8.

In FIG. 9, the image forming apparatus includes, similar to the foregoing image forming apparatus, the heat transporter 52 that connects the heaters 17 serving as the heating mechanism to the heat conservation member 44. The heat transporter 52 transfers heat from the heaters 17 to the heat conservation member 44, thereby heating the fixing liquid 45. Accordingly, it is possible to achieve the similar effect as that of the foregoing image forming apparatus.

As illustrated in FIG. 9, one of the heaters 17 is provided contacting the fixing liquid chamber 43 in the image forming apparatus 1. Thus, heat from the heater 17 contacting the fixing liquid chamber 43 is directly transmitted to the fixing liquid chamber 43 storing the fixing liquid 45.

Accordingly, heat from the heater 17 can be transferred effectively to the heat conservation member 44 without heat loss and without passing through the heat transporter 52. The heater 17 can be provided such that the heater 17 contacts completely the fixing liquid chamber 43, or is disposed close to the fixing liquid chamber 43.

Figure 10:
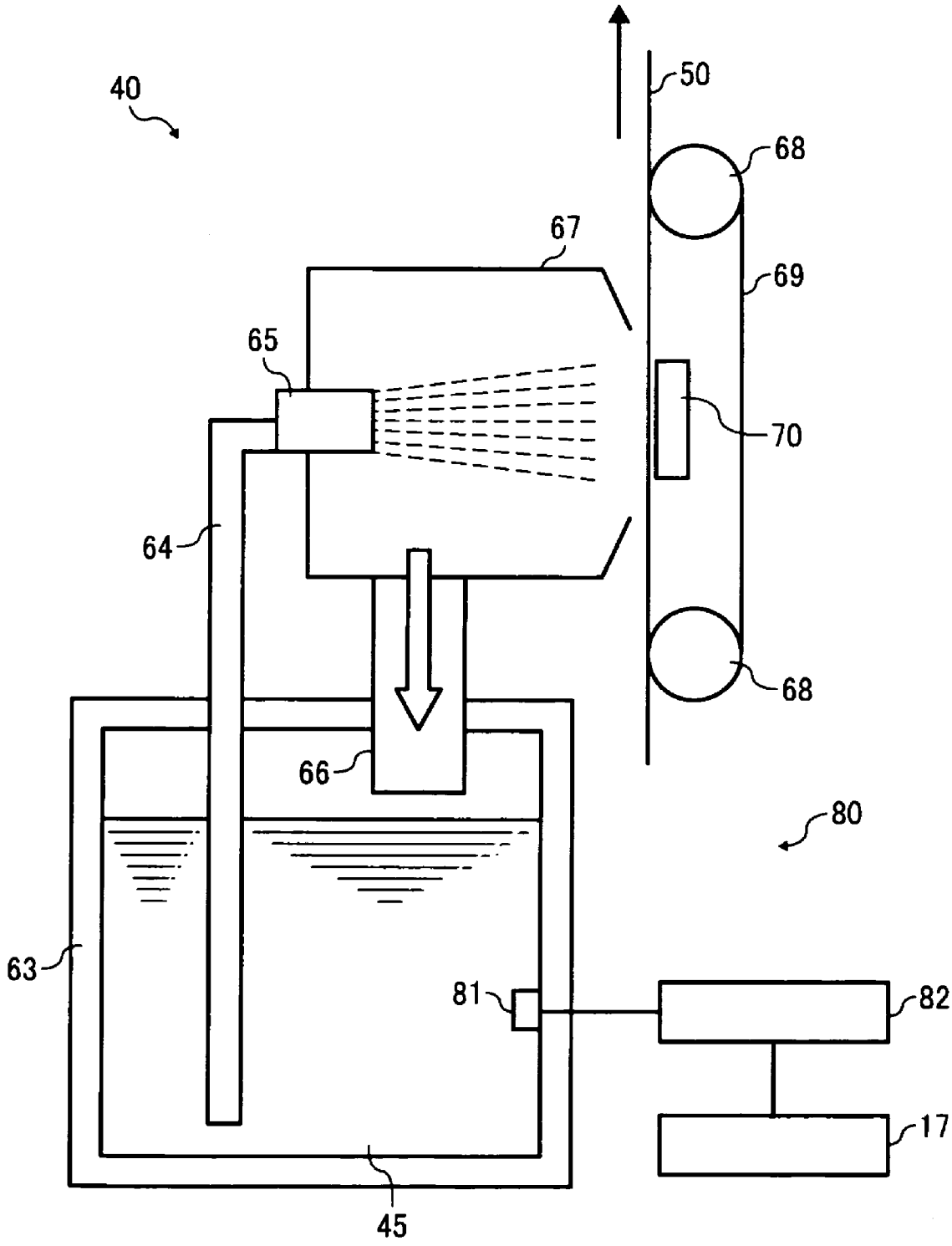
FIG. 10 is a schematic diagram illustrating the fixing device including a temperature control unit, according to still another exemplary embodiment of the present invention.

Referring now to FIG. 10, there is provided a schematic diagram illustrating the fixing device 40 including the temperature control unit 80, according to still another exemplary embodiment.

According to the present exemplary embodiment, the fixing device 40 includes a fixing liquid tank 63, a supply tube 64, a spray device 65, a recovery tube 66, a spray cover 67, rollers 68, a conveyance belt 69, and a second charging device 70.

The fixing liquid tank 63 serves as a container that stores the fixing liquid 45. The fixing liquid 45 in the fixing liquid tank 63 is pumped through the supply tube 64 and sprayed toward the recording medium 50 by the spray device 65. The spray device 65 is provided with a charging device not shown. The spray cover 67 holds the spray device 65 including the charging device. The spray cover 67 also includes the recovery tube 66, which recovers the fixing liquid 45 not adhered to the recording medium 50, to the fixing liquid tank 63. The conveyance belt 69 is provided facing the spray cover 67 and stretched between the rollers 68.

The second charging device 70 is provided to the inner loop of the conveyance belt 69 and charges the liquid droplets of the fixing liquid 45 sprayed by the spray device 65 from the rear side of the recording medium 50 so that the liquid droplets are attracted to the toner on the recording medium 50. The fixing liquid tank 63 is formed of heat conserving material.

The spray device 65 sprays the fixing liquid 45 toward the recording medium 50 so as to form the fixing liquid 45 into liquid droplets. The liquid droplets of the fixing liquid 45 are charged by the charging device, not shown, and then adhere to the toner selectively or in a concentrated manner by the Coulomb force, thereby fixing the toner on the recording medium 50.

Accordingly, the toner can be fixed on the recording medium 50 with a minimum amount of the fixing liquid required for fusing or swelling the toner. In other words, the fixing liquid scarcely adheres to the portion of the recording medium 50 where no toner is adhered. Thus, curling and/or cockling of the recording medium 50 can be reduced, if not prevented entirely.

The toner, not illustrated, on the recording medium 50 is negatively charged after the above-described image forming process. When the liquid droplets of the fixing liquid 45 sprayed by the spray device 65 are positively charged by the charging device, not shown, provided to the spray device 65, the positively charged liquid droplets are attracted to the toner due to the Coulomb force. Accordingly, the fixing liquid 45 is supplied selectively or in a concentrated manner.

According to the exemplary embodiment, the second charging device 70 is provided to the inner loop of the conveyance belt 58 so as to apply a negative charge from the back of the recording medium 50. Accordingly, the positively charged liquid droplets of the fixing liquid can quickly adhere to the toner on the recording medium 50.

However, in a case in which the charging polarity of the electrophotographic process is the opposite of the above-described exemplary embodiment, that is, the toner is positively charged, the sprayed fixing liquid is negatively charged, thereby forming negatively charged liquid droplets. In such a configuration, the second charging device 70 is configured to apply a positive charge from the rear side of the recording medium 50, so that the negatively charged liquid droplets are attracted to the toner on the recording medium 50.

In addition, it is possible to arbitrarily set the charge and the amount of the charge supplied to the liquid droplets of the fixing liquid 45, and the charge and the amount of the charge supplied to the toner by the second charging device 70.

The liquid droplets of the fixing liquid 45 which have not been used during fixing of the toner return to the fixing liquid tank 63 through the recovery tube 66 as indicated by the hollow arrow in FIG. 10.

In this case, a pair of pressure rollers, not shown, which guide a recording medium 50 therebetween, may be provided. With such a configuration, the recording medium 50 passes through the pair of the pressure rollers after the fixing liquid 45 is applied to the recording medium 50. Accordingly, the surface of the recording medium 50 bearing the toner is smoothed and/or the toner is packed onto the surface of the recording medium 50 so that glossiness of the surface can be enhanced and fixing ability can be improved.

A spray device using an electrostatic atomizing method in which static electricity is used, an inkjet method in which an inkjet nozzle is used, or an air-spray method in which the compressed air is used, or the like, can be employed as the spray device 65.

In such a case, when the particle diameter of the liquid droplets sprayed is too large, the liquid droplets are likely to aggregate, adversely affecting the toner image on the recording medium 50. For this reason, the particle diameter of the sprayed droplets is preferably less than or equal to approximately 20 μm.

The fixing liquid tank 63 may be provided with a filter in order to prevent foreign substances from mixing into the fixing liquid 45 inadvertently.

The configuration illustrated in FIG. 10 allows an opening of the fixing liquid tank 63 to be relatively small, thereby making it possible to adjust easily the temperature of the fixing liquid 45.

Alternatively, in addition to the fixing liquid tank 63, some or all of the recovery tube 66 and/or the spray cover 67 may be covered with the heat conservation member.

According to the exemplary embodiment illustrated in FIG. 10, the fixing device 40 includes the temperature control unit 80 to maintain the fixing liquid 45 at a certain temperature. The temperature control unit 80 includes the fixing liquid chamber 43, the heaters 17 provided in the image forming unit 100, the spray device 65, the temperature sensor 81, and the controller 82.

The heaters 17 provided in the image forming unit 100 transmit heat to the heat conservation member 44 of the fixing liquid chamber 43. The spray device 65 sprays the fixing liquid 45 to the toner on the recording medium 50 to fix the toner. The temperature sensor 81 is provided to the inner wall of the fixing liquid chamber 43 so as to detect the temperature of the fixing liquid 45 in the fixing liquid chamber 43. The controller 82 is connected to the temperature sensor 81. Based on the detection result provided by the temperature sensor 81, the controller 82 regulates the amount of heat transmitted from the heaters 17 to the heat conservation member 44.

Figure 11:
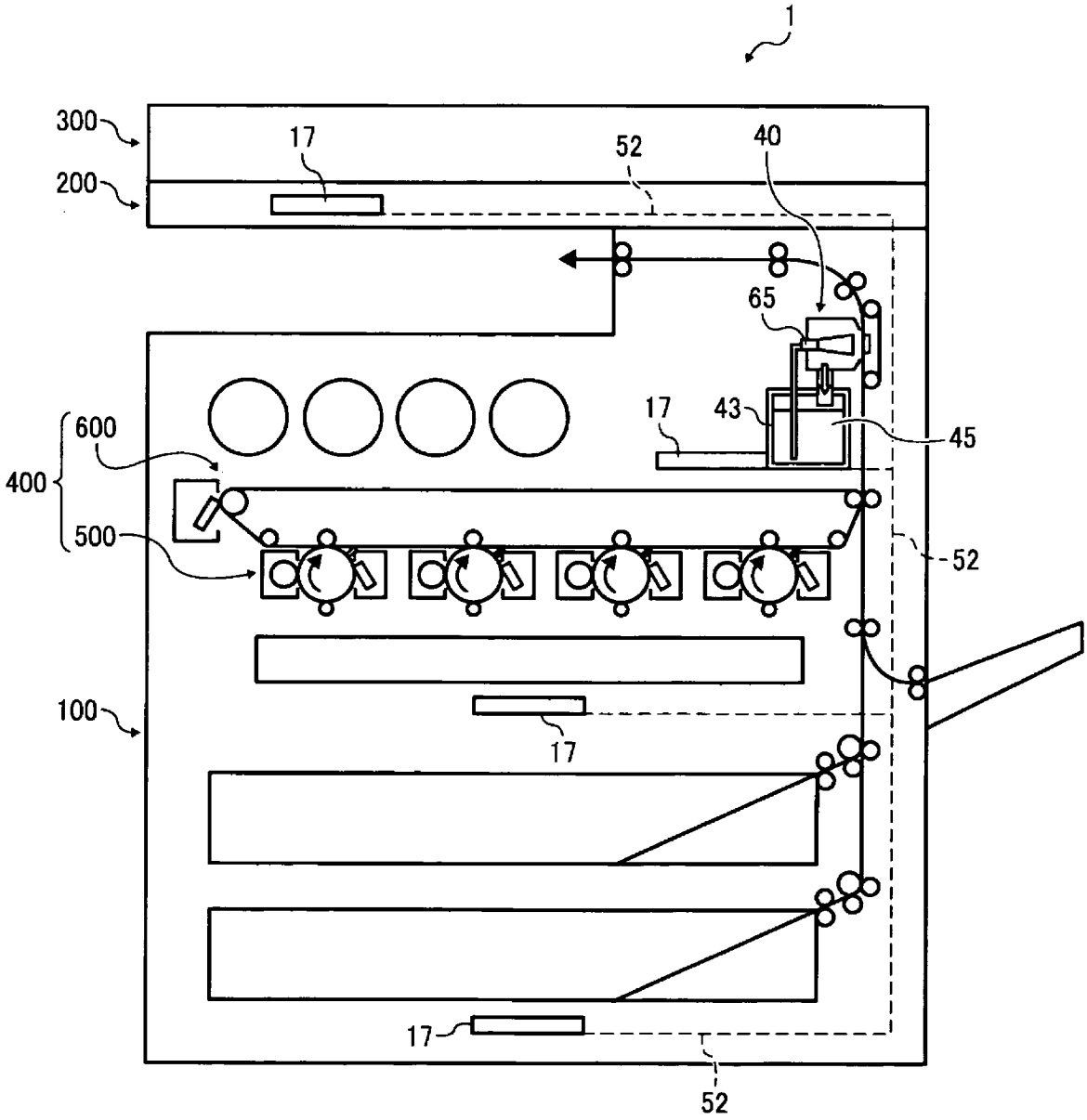
FIG. 11 is a schematic diagram illustrating heat transmission of a heater in the image forming apparatus including the fixing device of FIG. 10, according to still another exemplary embodiment of the present invention.

Referring now to FIG. 11, there is provided a conceptual diagram illustrating heat transmission from the heaters 17 to the heat conservation member 44 in the image forming apparatus 1 equipped with the fixing device 40 of FIG. 10.

In FIG. 11, the image forming apparatus includes, similar to the foregoing image forming apparatus, the heat transporter 52 serving as a heat transport mechanism that connects the heaters 17 serving as the heating mechanism to the heat conservation member 44 of the fixing liquid chamber 43. The heat transporter 52 transfers heat from the heaters 17 to the heat conservation member 44, thereby heating the fixing liquid 45.

Based on the detection result provided by the temperature sensor 81 illustrated in FIG. 10, the controller 82 controls the operation of the heaters 17 so that the amount of heat transmitted from the heater 17 to the heat conservation member 44 is regulated. Accordingly, the temperature of the fixing liquid 45 is regulated to be in the range of approximately 20 to 60 degrees Centigrade.

Similarly, instead of controlling the operation of the heaters 17 with the controller 82, the controller 82 may control the heat transporter 52, for example, to regulate the temperature of the fixing liquid 45 to be in the range of 20 to 60 degrees Centigrade.

Through transmission of heat, the temperature of the fixing liquid 45 is retained. The spray device 65 serving as the fixing liquid application mechanism sprays the heated fixing liquid 45 toward the recording medium 50 so that the toner on the recording medium 50 is fused or caused to swell, thereby fixing the toner onto the recording medium 50.

The temperature sensor 81 detects the temperature of the fixing liquid 45 supplied by the spray device 65. In accordance with the detection result provided by the temperature sensor 81, the controller 82 regulates the amount of heat transmitted from the heaters 17 to the heat conservation member 44. Accordingly, a predetermined temperature of the fixing liquid 45 can be maintained, and a similar effect to the foregoing can be obtained.

Now, a description will be given of preferred material for a toner used in the exemplary embodiments of the present invention.

[Resin]

The toner according to the exemplary embodiment may include, but is not limited to, biodegradable resins. The term "biodegradable" means breakage of molecular binding by microorganisms such as bacteria and fungi, and enzyme. A biodegradable resin refers to a resin having biodegradable characteristics, that is, a resin that can be, biodegraded and incorporated in an ecosystem without contaminating the environment. Such a biodegradable resin can be categorized into approximately three types depending on its method of manufacture method: A microbial product, a chemical composition, and a natural product.

According to the exemplary embodiments, the toner may include the biodegradable resin of a microbial product, a chemical composition, or a natural product, or any combination thereof.

Specific examples of the biodegradable resins using the microbial product include, but are not limited to, polybutyric acids such as Poly(3-hydroxybutyrate); a copolymer of 3-hydroxybutyric acid and 3-hydroxyvaleric acid; a copolymer of 3-hydroxybutyric acid and 4-hydroxybutyric acid; and polyhydroxyalkanoate such as poly(3-hydroxypropionate), poly(3-hydroxybutyrate), poly(3-hydroxyhexanoate), poly(3-hydroxyheptanoate), and poly(3-hydroxyoctanoate), and their copolymers.

Specific examples of the biodegradable resins using the chemical composition include, but are not limited to, aliphatic polyester, a copolymer of aliphatic polyester and polyamide, a copolymer of aliphatic polyester and polyurethane, a copolymer of aliphatic polyester and aromatic polyester, polyvinyl alcohol, and polyethylene oxide.

Specific examples of the aliphatic polyesters include, but are not limited to, polylactic acid, polymalic acid, polylactide, polyglycolide, poly(β-propiolactone), poly(γ-valerolactone), poly(ϵ-caprolactone), polyethylene oxalate, polyethylene succinate, polybutylene succinate, polybutylene adipate, polybutylene sebacate, polyhexamethylene sebacate, polyneopentyl oxalate, and copolymers thereof.

Specific examples of the copolymers of aliphatic polyester and polyamide include, but are not limited to, copolymers of aliphatic polyester and polyamide such as nylon 6, nylon 46, and nylon 66, for example.

Specific examples of the copolymers of aliphatic polyester and aromatic polyester include, but are not limited to, copolymers of aliphatic polyester and aromatic dicarboxylic acid such as terephthalic acid, isophthalic acid, naphthalene dicarboxylic acid, p-hydroxybenzoic acid, p-hydroxyethyl benzoic acid, and p-hydroxyphenyl acetic acid, or copolymers of aliphatic polyester and aromatic oxycarboxylic acid.

Specific examples of the biodegradable resins using the natural product include, but are not limited to, cellulose obtained from pulp, cotton, wool, and the like; chitin and chitosan obtained from such crustaceans as crabs, prawns, and the like; starch obtained from cornstarch and the like; and a mixture thereof.

It is preferable to use polybutyric acid, polyhydroxyalkanoate, and aliphatic polyester, and particularly, polylactic acid and poly(ϵ-caprolactone), because such resins can be decomposed easily by microorganisms, and are compatible with the fixing liquid of the exemplary embodiments of the present invention. In other words, such resins demonstrate good affinity with paper and good fixing ability.

According to the exemplary embodiments, resins described below, for example, can be mixed with the biodegradable resins described above so long as biodegradability is not adversely affected.

Specific examples of such resins include, but are not limited to, styrene polymers and substituted styrene polymers such as polystyrene, poly-p-chlorostyrene and polyvinyltoluene; styrene copolymers such as styrene-p-chlorostyrene copolymers, styrene-vinyltoluene copolymers, styrene-vinylnaphthalene copolymers, styrene-ester acrylate copolymers, styrene-ester methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-acrylonitrile-indene copolymers; and other resins such as polyvinyl chloride, phenolic resin, natural modified phenolic resin, natural modified maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, coumarone-indene resin, petroleum-based resin, polyethylene, polypropylene, polymethylene, and polyurethane elastomer, ethylene-ethyl acrylate copolymers, ethylene-acetic acid vinyl copolymers, ionomer resin, styrene-butadiene copolymers, styrene-isoprene resin, linear saturated polyester resin, paraffin, and so forth.

A mixing ratio of the resins described above and the biodegradable resins depends on the type of biodegradable resin. Generally, however, the content is preferably less than or equal to approximately 70 parts by weight, per 100 parts by weight, of the biodegradable resins. When the content is greater than approximately 70 parts by weight, biodegradability is most likely to deteriorate.

Examples of the copolymers obtained by resins described above include, but are not limited to, random copolymers, block copolymers, and graft copolymers. The block copolymers are preferred, because the block copolymers are less likely to degrade biodegradability.

In addition, the toner of the exemplary embodiment of the present invention may include other constituents, such as a colorant, an inorganic particulate material, a charge controlling agent, a fluidity improving agent, a cleanability improving agent, a metal soap, and a magnetic material.

The colorant is not particularly limited, and can be selected from known dyes and pigments in accordance with the intended use. Specific examples of the dyes and pigments include carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH (C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, Naphthol Blue Black, Food Red No. 2, Food Red No. 3, Food Red No. 40, Food Red No. 102, Food Red No. 104, Food Red No. 105, Food Red No. 106, Food Yellow No. 4, Food Yellow No. 5, Food Blue No. 1, Food Blue No. 2, Food Green No. 3, Food Red No. 2 Aluminum Lake, Food Red No. 3 Aluminum Lake, Food Red No. 40 Aluminum Lake, Food Red No. 102 Aluminum Lake, Food Red No. 104 Aluminum Lake, Food Red No. 105 Aluminum Lake, Food Red No. 106 Aluminum Lake, Food Yellow No. 4 Aluminum Lake, Food Yellow No. 5 Aluminum Lake, Food Blue No. 1 Aluminum Lake, Food Blue No. 2 Aluminum Lake, Food Green No. 3 Aluminum Lake, and the like.

These materials can be used alone or in combination. In particular, in view of environmental and human health and safety, Naphthol Blue Black, other food colorants, food lakes, and the like are preferably used.

The toner preferably includes a colorant in an amount of from 1 to 15% by weight, and more preferably from 3 to 10% by weight of the toner. When less than 1% by weight, the resultant toner cannot produce images with high image density. When greater than 15% by weight, problems in that the resultant toner cannot produce images with high image density and has poor electrostatic properties due to defective dispersion of the colorant in the toner, may occur.

Master batches, which are complexes of a colorant with a resin, can be used as the colorant of the toner of the present invention.

The resins for use as the binder resin of the master batches are not particularly limited, and can be selected from any known resins in accordance with the purpose.

Specific examples of the resins for use as the binder resin of the master batches may include, but are not limited to, biodegradable resins, polymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, carnauba waxes, rice waxes, hydrogenated jojoba waxes, Japan waxes, Candelila waxes, and the like. These can be used alone or in combination.

Specific examples of the polymers of styrene or styrene derivatives include, but are not limited to, polyester resins, polystyrene, poly-p-chlorostyrene and polyvinyltoluene. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batches can be prepared by mixing one or more of the resins as mentioned above and one or more of the colorants as mentioned above and kneading the mixture, while applying a high shearing force thereto.

In this case, an organic solvent can be added to increase the interaction between the colorant and the resin. In addition, preferably a flushing method is used in which an aqueous paste including a colorant and water is mixed with a resin dissolved in an organic solvent and kneaded so that the colorant is transferred to the resin side (i.e., the oil phase), and then the organic solvent (and water, if desired) is removed, because the resultant wet cake can be used as is without being dried. When performing the mixing and kneading process, preferably dispersing devices capable of applying a high shearing force such as three-roll mills are used.

The charge controlling agent is not particularly limited, and can be selected from any known charge controlling agents in accordance with the purpose.

Specific examples thereof include, but are not limited to, Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, and so forth. These materials can be used alone or in combination.

The charge controlling agent can be selected from any marketed charge controlling agents. Specific examples of the marketed charge controlling agents include BONTRON® 03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, and so forth.

The content of the charge controlling agent in the toner of the present invention is determined depending on such variables as choice of binder resin, presence of additives, manufacturing method of toner (such as dispersion method), and so forth, and is not particularly limited.

In general, the content of the charge controlling agent is preferably from 0.1 to 10 parts by weight, and more preferably from 0.2 to 5 parts by weight, per 100 parts by weight of the binder resin included in the toner. When the content is less than approximately 0.1 parts by weight, a good charge property cannot be imparted to the toner. When the content is more than approximately 10 parts by weight, the charge quantity of the toner increases excessively, thereby increasing the electrostatic attraction between the developing roller and the toner, resulting in deterioration of fluidity and decrease of image density.

The inorganic particulate material is preferably used as an external additive for a toner to enhance fluidity, development ability, chargeability, and so forth of the toner.

The inorganic particulate material is not particularly limited, and can be selected from known inorganic particulate materials in accordance with the purpose. Specific examples thereof include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These are used alone or in combination.

The inorganic particulate material preferably has a primary particle diameter of from approximately 5 nm to 2 μm, and more preferably from approximately 5 nm to 500 nm. Further, the inorganic particulate material preferably has a specific surface area of from approximately 20 to 500 $m^2/g$ when measured by a BET method.

A toner preferably includes the inorganic particulate material of from approximately 0.01% to 5.0% by weight, and more preferably from approximately 0.01% to 2.0% by weight.

The fluidity improver is a surface treatment agent to increase hydrophobicity of a toner so as to prevent deterioration of fluidity and chargeability thereof even in an environment of high humidity.

Specific examples thereof include, but are not limited to, a silane coupling agent, a sililating agent, a silane coupling agent having an alkyl fluoride group, an organic titanate coupling agent, an aluminium coupling agent, a silicone oil, a modified silicone oil, and so forth.

Such a fluidity improver can be added to silica and titanium oxide to form hydrophobic silica and hydrophobic titanium oxide, and it is preferable to use hydrophobic silica and hydrophobic titanium oxide.

The cleanability improver is added to remove a developer remaining on a photoreceptor and a primary transfer medium after being transferred. Specific examples of the cleanability improver include, but are not limited to, fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from approximately 0.01 to 1 μm.

The magnetic material is not particularly limited, and can be selected from known magnetic material in accordance with the purpose. Specific examples of the magnetic materials include iron powders, magnetite and ferrite. In addition, in terms of tonality, it is preferable to select white color from the examples of the magnetic materials.

[Method of Preparation of Toner]

Toners are broadly classified into two types, pulverization toners and polymerization toners.

Pulverization toners may be manufactured as follows. First, toner components such as a binder resin, a colorant, a charge controlling agent, a release agent, and a magnetic material are mixed using a mixer such as HENSCHEL MIXER and a ball mill.

The mixture prepared in a manner described above is dissolve-kneaded using a thermal kneader such as heating roller, kneader, and extruder so that the toner components are evenly dispersed in the binder resin. The kneaded mixture is cooled and allowed to solidify, and subsequently pulverized by a hammer mill, a jet mill, or the like. The pulverized particles are classified by a cyclone, a micron separator, or the like. Thus, a toner is obtained.

The toner thus obtained is optionally mixed with a surface treatment agent using a mixer such as HENSCHEL MIXER, if desired.

Polymerization toners are manufactured by the following methods. For example, spherical toner particles can be obtained by spraying a melted toner component mixture into air using a disk or a multi-fluid nozzle. Alternatively, toner particles can be directly obtained by wet methods such as suspension polymerization methods; dispersion polymerization methods using an organic solvent in which a monomer is soluble and the resultant polymer is insoluble; and emulsion aggregation methods such as soap-free polymerization method in which monomers are directly polymerized in the presence of a water-soluble polar polymerization initiator; and heteroaggregation methods in which primary polar emulsion-polymerized particles are associated with particles having opposite polarity.

Among these methods, a method in which a monomer composition including a monomer and other toner components is subjected to polymerization is preferable. In addition, seed polymerization methods, in which polymerized particles to which a monomer is further adsorbed are subjected to polymerization with a polymerization initiator, are also preferable.

The toner thus obtained is optionally mixed with a carrier such as iron powders and glass beads using a mixer such as V-BLENDER.

Referring back to manufacturing methods of the pulverization toner, toner components such as a biodegradable resin and a binder resin may be mixed all together. Alternatively, a biodegradable resin, which is colored with a dye, may be dispersed in a binder resin optionally together with an antistatic agent, if desired. The mixture may be finely pulverized into particles having an average particle diameter of from approximately 1 to 20 μm.

The previously colored biodegradable resin provides a toner with good coloring characteristics, thereby making it possible to form well-colored images.

A toner including a biodegradable resin preferably has an average particle diameter of approximately 1 μm or more, and more preferably, approximately 3 μm or more. Further, the toner preferably has an average particle diameter of approximately 20 μm or less, more preferably approximately 15 μm or less, and more preferably still approximately 8 μm or less.

When the average particle diameter is less than approximately 1 μm, adherence of the toner is most likely strong relative to the photoreceptor, resulting in poor primary transfer performance. By contrast, when the average particle diameter is greater than approximately 20 μm, the toner may have a relatively small surface area, compared to the weight. As a result, a fixing liquid may not be immediately absorbed, thereby preventing high-speed printing.

Toners used for the exemplary embodiments of the present invention were obtained as follows. In the following descriptions, the numbers represent weight ratios in parts, unless otherwise specified.

(Toner 1)

First, 100 parts of a polylactic acid resin, 10 parts of a carbon black (i.e., a colorant), 3 parts of a charge controlling agent TRH (manufactured by Hodogaya Chemical Co., Ltd.), and 2 parts of a low-molecular-weight polypropylene (i.e., a release agent) were mixed. The mixture was melt-kneaded by a double-axis extruder at 145° C. The kneaded mixture was then cooled, pulverized, and classified. Accordingly, a mother toner having an average particle diameter of approximately 10 μm was prepared. Next, 100 parts of the mother toner were mixed with 0.3 parts of hydrophobized silica particles (i.e., fluidizers) having an average particle diameter of 0.015 μm using HENSCHEL MIXER for approximately 2 minutes. Accordingly, a toner 1 is prepared.

(Toner 2)

First, 100 parts of a poly(ε-caprolactone), 10 parts of a carbon black (i.e., a colorant), 3 parts of a charge controlling agent TRH (manufactured by Hodogaya Chemical Co., Ltd.), and 2 parts of a low-molecular-weight polypropylene (i.e., a release agent) were mixed. The mixture was melt-kneaded by a double-axis extruder at 145° C. The kneaded mixture was then cooled, pulverized, and classified. Accordingly, a mother toner having an average particle diameter of approximately 10 μm was prepared. Next, 100 parts of the mother toner were mixed with 0.3 parts of hydrophobized silica particles (i.e., fluidizers) having an average particle diameter of 0.015 μm using HENSCHEL MIXER for approximately 2 minutes. Accordingly, a toner 2 is prepared.

(Fixing Liquid)

The fixing liquid according to the exemplary embodiment of the present invention includes a softening agent capable of dissolving or causing swelling of a toner, and a solvent capable of dissolving or dispersing the softening agent.

(Softening agent)

The softening agent for use in the present invention is not particularly limited, and can be selected from any known softening agent that is compatible with resin components in a toner in accordance with the purpose. Specific examples of the softening agent according to the exemplary embodiment of the present invention include, but are not limited to, ester compounds. The ester compounds are preferable, since the ester compounds are compatible with a number of toners. Specific examples of the ester compounds include aliphatic ester and aromatic ester.

Specific examples of the aliphatic ester include, but are not limited to, monocarboxylate compounds such as ethyl laurate, hexyl laurate, ethyl tridecylate, isopropyl tridecylate, ethyl myristate, and isopropyl myristate; dicarboxylic monoester compounds such as ethyl succinate, ethyl adipate, isobutyl adipate, isopropyl adipate, isodecyl adipate, ethyl sebacate, butyl sebacate, ethoxyethyl succinate, butoxyethyl succinate, ethoxyethyl adipate, butoxyethyl adipate, and ethoxyethyl sebacate; and dicarboxylic diester compounds such as diethyl succinate, dibutyl succinate, diethyl adipate, diisobutyl adipate, diisopropyl adipate, diisodecyl adipate, diethyl sebacate, dibutyl sebacate, diethoxyethyl succinate, dibutoxyethyl succinate, dimethoxyethyl adipate, diethoxyethyl adipate, dibutoxyethyl adipate, and diethoxyethyl sebacate, dibutoxyethyl sebacate.

Specific examples of the aromatic ester include, but are not limited to, diester compounds such as dioctyl phthalate and diisononyl phthalate; and triester compounds such as trimellitic tris or 2-ethylhexyl.

Furthermore, in addition to the ester compounds described above, triethyl citrate, acetyl triethyl citrate, tributyl citrate, acetyl tributyl citrate, monoacetin, diacetin, triacetin, ethylene glycol diacetate, diethylene glycol diacetate, triethylene glycol diacetate, propylene carbonate, glycerol 1,2-carbonate, 4-methoxymethyl-1,3-dioxolan-2-one, and limonene may be used.

Among the softening agents described above, the aliphatic ester is preferably used, since the aliphatic ester demonstrates good compatibility with the toner including the biodegradable resins according to the exemplary embodiment of the present invention. More preferably, the aliphatic diacid ester is used because of its odorlessness and harmlessness.

According to the exemplary embodiment, the softening agent may be of a liquid type having fluidity, or a semisolid softening agent such as a gel and a wax. When the softer is a solid type, the softening agent can be used by dissolving or dispersing in a suitable solvent.

The fixing liquid preferably includes the softening agent in an amount of from approximately 0.5% to 80% by weight, and more preferably from approximately 1% to 70% parts by weight. When less than 0.5% parts by weight, the toner may not adequately dissolve or swell. By contrast, when greater than 80% parts by weight, it may not be able to reduce fluidity of the toner for an extended period of time, causing the fixing toner layer to have viscosity.

(Solvent)

According to the exemplary embodiment of the present invention, the solvent for the fixing liquid preferably includes water as a main component, thereby reducing unpleasant odor. Water is not a volatile organic compound (VOC), and thus water is suitable for use in office environments.

Alternatively, a mixed solvent including water and a water-soluble solvent may be used as a solvent. Specific examples of the water-soluble solvent include, but are not limited to, ethanol and isopropanol.

Furthermore, a hydrophobic solvent may be used as a solvent. Specific examples of the hydrophobic solvent include, but are not limited to, silicone-based oils, olefinic solvents, paraffinic solvents, and fluorine solvents.

Specific examples of the silicone-based oils include, but are not limited to, polydimethylsiloxane having a viscosity from approximately 1 to 10 mPa/second, methyl cyclosiloxan tetramer and methyl cyclosiloxan pentamer.

Specific examples of the paraffinic solvents includes, but are not limited to n-decane, n-dodecane, and n-undecane.

Specific examples of the fluorine solvents include, but are not limited to, hydrofluoroether or the like.

(Other Constituents)

The fixing liquid according to the exemplary embodiment may optionally use an auxiliary dispersant, a surfactant, and a pH adjuster, if desired.

Specific examples of the auxiliary dispersants include, but are not limited to glycerin, propylene glycol, butylene glycol, diethylene glycol, polyethylene glycol, and 1,3-butanediol. Such auxiliary dispersants may improve dispersibility of the softening agent and wettability with the toner.

Specific examples of the pH adjusters include, but are not limited to, disodium hydrogenphosphate or the like. Such pH adjusters may suppress hydrolysis of the softening agent.

(Odor)

According to the exemplary embodiment, an odor index of the fixing liquid is preferably no more than 10. The odor index can be obtained as follows. First, a gas or a liquid having an odor are diluted with an odor-less gas and liquid (water). A diluted ratio (hereinafter referred to as odor intensity) is obtained therefrom and raised to the 10th power. The odor intensity is obtained as follows:

$$\text{Odor Index}=10\times\text{Log (odor intensity)}$$

For example, when a gas or a liquid having an odor is diluted 100 times with an odorless gas or a liquid and the odor is not detected, the odor intensity is 100, and the odor index of 20 is obtained as follows:

$$\text{Odor Index}=10\times\text{Log (100)}=10\times2=20$$

It is preferable that the odor index of the fixing liquid be less than or equal to 10. In this case, unpleasant odor is not detected in an ordinary office environment. In general, when the odor index is 10, 18 people out of 20 people detect no odor. Thus, when the odor index is equal to or less than 10, unpleasant odor is not detected in an ordinary office environment.

(Toxicity)

Also, with regard to the fixing liquid, it is preferable that the acute oral toxicity $LD_{50}$ (50% Lethal Dose according to American Industrial Hygiene Association) thereof be equal to or greater than or 3 g/kg, from the viewpoint of human safety. For example, the acute oral toxicity $LD_{50}$ of salt is 3 g/kg. Thus, a fixing liquid the acute oral toxicity $LD_{50}$, of which is greater than or equal to 3 g/kg, is considered to be safe for humans.

Fixing liquids used for the exemplary embodiments of the present invention were obtained as follows.

(Fixing Liquid 1)

A mixture of 53.9% by weight of distilled water, 35% by weight of propylene glycol ($LD_{50}$=20 g/kg), 10% by weight of diethoxyethyl succinate ($LD_{50}$=5 g/kg), 1% by weight of methyl ether dimethyl silicone, and 0.1 by weight of disodium hydrogenphosphate was stirred to prepare the fixing liquid 1. The odor index of the fixing liquid 1 was 0.

(Fixing Liquid 2)

A mixture of 45% by weight of distilled water, 20% by weight of glycerol 1,2-carbonate, and 35% by weight of propylene carbonate ($LD_{50}$=29 g/kg) was stirred to prepare the fixing liquid 2. The odor index of the fixing liquid 2 was 0.

Exemplary Embodiment 1

A toner image was formed on a PPC (plain paper copier) sheet by an image forming apparatus as illustrated in FIG. 5 using the toner 1 and the fixing liquid 1. The operating temperature was set to 10 degrees Centigrade. The temperature of the fixing liquid 1 was 20 degrees Centigrade and 50 degrees Centigrade. The surface of the toner image was rubbed with a rag. The degree by which the toner had been fixed onto the PPC sheet was evaluated depending on whether the toner adhered to the rag. The results are shown in Table 1.

TABLE 1

| TEMPERATURE OF FIXING LIQUID 1 (degree C.) | VISCOSITY OF FIXING LIQUID 1 (mPa/second) | TONER IMAGE |
|---|---|---|
| 20 | 5.15 | ○ |
| 50 | 1.56 | ○ |

○ indicates that no toner was observed on the rag, and the toner was fixed on the surface of the PPC sheet.

Exemplary Embodiment 2

A toner image was formed on a PPC (plain paper copier) sheet by an image forming apparatus as illustrated in FIG. 7 using the toner 1 and the fixing liquid 2. The operating temperature was set to 30 degrees Centigrade. The temperature of the fixing liquid 2 was 50 degrees Centigrade. Droplets of the fixing liquid 2 were supplied with a voltage of +1 kV by a charging device. The PPC sheet was supplied with a voltage of −2 kV. The surface of the toner image was rubbed with a rag. The degree by which the toner had been fixed onto the PPC sheet was evaluated depending on whether the toner adhered to the rag. The results are shown in Table 2.

TABLE 2

| TEMPERATURE OF FIXING LIQUID 2 (degree C.) | VISCOSITY OF FIXING LIQUID 2 (mPa/second) | TONER IMAGE |
|---|---|---|
| 50 | 1.27 | ○ |

○ indicates that no adhesion of toner was observed on the rag, and the toner was fixed on the surface of the PPC sheet.

Exemplary Embodiment 3

A toner image was formed on a PPC (plain paper copier) sheet by an image forming apparatus as illustrated in FIG. 9 using the toner 2 and the fixing liquid 2. The operating temperature was set to 10 degrees Centigrade. The temperature of the fixing liquid 2 was set to 30 degrees Centigrade, 60 degrees Centigrade, and 70 degrees Centigrade. Droplets of the fixing liquid 2 were supplied with a voltage of −kV by a charging device. The PPC sheet was supplied with a voltage of +2 kV. The surface of the toner image was rubbed with a rag. When the temperature of the fixing liquid 2 was raised to approximately 70 degrees Centigrade, the fixing liquid 2 was degraded. The degree by which the toner had been fixed onto the PPC sheet was evaluated depending on whether the toner adhered to the rag. The results are shown in Table 3.

TABLE 3

| TEMPERATURE OF FIXING LIQUID 2 (degree C.) | VISCOSITY OF FIXING LIQUID 2 (mPa/second) | TONER IMAGE |
|---|---|---|
| 30 | 1.91 | ○ |
| 60 | 1.03 | ○ |
| 70 | 0.95 | Δ |

○ indicates that no adhesion of toner was observed on the rag, and the toner was fixed on the surface of the PPC sheet.
Δ indicates that no toner adhesion was observed on the rag, and the toner was fixed on the surface of the PPC sheet. However, the PPC sheet was curled.

Exemplary Embodiment 4

A toner image was formed on a PPC (plain paper copier) sheet by an image forming apparatus as illustrated in FIG. 11 using the toner 2 and the fixing liquid 1. The ambient temperature was set to 30 degrees Centigrade. The temperature of the fixing liquid 1 was set to 60 degrees Centigrade. Droplets of the fixing liquid 2 were supplied with a voltage of −2 kV by a charging device. The PPC sheet was supplied with a voltage of +2 kV. The surface of the toner image was rubbed with a rag. The degree by which the toner had been fixed onto the PPC sheet was evaluated depending on whether the toner adhered to the rag. The results are shown in Table 4.

TABLE 4

| TEMPERATURE OF FIXING LIQUID 1 (degree C.) | VISCOSITY OF FIXING LIQUID 1 (mPa/second) | TONER IMAGE |
|---|---|---|
| 60 | 1.20 | ○ |

○ indicates that no adhesion of toner was observed on the rag, and the toner was fixed on the surface of the PPC sheet.

Furthermore, elements and/or features of different exemplary embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A temperature control unit to maintain a temperature of a fixing liquid, comprising:

a container, some or all of which is formed of a heat conservation member, configured to store the fixing liquid that dissolves or causes a toner to swell;

a heater configured to heat the container through the heat conservation member thereof;

a temperature sensor configured to detect a temperature of the fixing liquid in the container;

a controller configured to regulate an amount of heat that is transferred from the heater to the heat conservation member of the container based on a detection result provided by the temperature sensor;

a fixing liquid applicator configured to supply the fixing liquid in the container to a toner on a recording medium to fix the toner onto a recording medium, the fixing liquid applicator including an ultrasonic transducer configured to spray the fixing liquid in a droplet form and a fan configured to generate an air current to direct the sprayed fixing liquid onto the recording medium; and a charging device configured to charge the droplets of the fixing liquid so as to adhere the fixing liquid onto the toner, wherein the fixing liquid is a mist-type fixing liquid.

2. The temperature control unit according to claim 1, further comprising:

a heat transporter configured to transfer heat from the heater to the heat conservation member.

3. The temperature control unit according to claim 2, wherein the controller controls the heater or the heat transporter for transferring the heat from the heater based on the detection result provided by the temperature sensor.

4. The temperature control unit according to claim 2, wherein the heat transporter is one of a heat pipe and a heat plane.

5. The temperature control unit according to claim 1, wherein the heater is provided so as to contact the heat conservation member.

6. The temperature control unit according to claim 1, wherein the fixing liquid applicator includes an application member that contacts the toner so as to supply the fixing liquid thereto.

7. The temperature control unit according to claim 6, wherein the applicator and the application member are provided in the container.

8. The temperature control unit according to claim 1, wherein the fixing liquid applicator includes a spray device configured to spray the fixing liquid onto the recording medium.

9. The temperature control unit according to claim 1, wherein the heat conservation member includes at least one of paraffin, sodium acetate, sodium acetate hydrate, calcium chloride hydrate, sodium sulfate hydrate, sodium thiosulfate hydrate, and sodium carbonate.

10. The temperature control unit according to claim 1, wherein the fan is configured to direct the air current directly towards the recording medium.

11. An image forming apparatus, comprising:

an image bearing member configured to bear a latent image on a surface thereof;

a latent image forming device configured to form the latent image on the image bearing member;

a developing device configured to develop the latent image with a developer including a toner to form a toner image;

a transfer device configured to transfer the toner image on the image bearing member onto a recording medium; and a temperature control unit configured to maintain a temperature of a fixing liquid, the temperature control unit including a container, some or all of which is formed of a heat conservation member, configured to store the fixing liquid that dissolves or causes the toner to swell;

a heater configured to heat the container through the heat conservation member thereof;

a temperature sensor configured to detect a temperature of the fixing liquid in the container;

a controller configured to control an amount of heat that is transferred from the heater to the heat conservation member of the container based on a detection result provided by the temperature sensor;

a fixing liquid applicator configured to supply the fixing liquid in the container to the toner on a recording medium to fix the toner onto the recording medium, the fixing liquid applicator including an ultrasonic transducer configured to spray the fixing liquid in a droplet form and a fan configured to generate an air current to direct the sprayed fixing liquid onto the recording medium; and a charging device configured to charge the droplets of the fixing liquid so as to adhere the fixing liquid onto the toner, wherein the fixing liquid is a mist-type fixing liquid.

12. The image forming apparatus according to claim 11, wherein the toner image is formed with a toner having a biodegradable resin.

13. The image forming apparatus according to claim 12, wherein the biodegradable resin includes polylactate or poly (ϵ-caprolactone).

14. The image forming apparatus according to claim 11 further comprising:

a first heat transporter configured to transfer heat from the heater to the heat conservation member, wherein the heater is arranged near the transfer device.

15. The image forming apparatus according to claim 14, wherein the transporter is one of a heat pipe and a heat plane.

16. The image forming apparatus according to claim 14, wherein the heater is configured to dehumidify the image forming apparatus.

17. The image forming apparatus according to claim 11, wherein the fan is configured to direct the air current directly towards the recording medium.

* * * * *